US008511277B2

(12) United States Patent
Drachko

(10) Patent No.: US 8,511,277 B2
(45) Date of Patent: Aug. 20, 2013

(54) "TURBOMOTOR" ROTARY MACHINE WITH VOLUMETRIC EXPANSION AND VARIANTS THEREOF

(76) Inventor: Yevgeniy Fedorovich Drachko, Kiev (UA)

( * ) Notice: Subject to any disclaimer, the term of this patent is extended or adjusted under 35 U.S.C. 154(b) by 57 days.

(21) Appl. No.: 13/383,421

(22) PCT Filed: Nov. 6, 2009

(86) PCT No.: PCT/UA2009/000056
§ 371 (c)(1),
(2), (4) Date: Jan. 11, 2012

(87) PCT Pub. No.: WO2011/010978
PCT Pub. Date: Jan. 27, 2011

(65) Prior Publication Data

US 2012/0134860 A1 May 31, 2012

(30) Foreign Application Priority Data

Jul. 20, 2009 (UA) ..... 200907575

(51) Int. Cl.
*F02B 53/00* (2006.01)
*F01B 13/04* (2006.01)
*F03C 2/00* (2006.01)

(52) U.S. Cl.
USPC ..... 123/245; 123/241; 123/242; 123/243; 123/43 B; 418/34; 418/35; 418/36; 418/37

(58) Field of Classification Search
USPC .... 123/241, 242, 246, 43 B, 245; 418/33–38
See application file for complete search history.

(56) References Cited

U.S. PATENT DOCUMENTS

| | | | | |
|---|---|---|---|---|
| 1,729,242 | A * | 9/1929 | Bregere | 123/43 B |
| 1,944,875 | A * | 1/1934 | Bullington | 123/245 |
| 4,138,847 | A | 2/1979 | Hill | |
| 8,037,861 | B2 * | 10/2011 | Liang | 123/241 |
| 8,210,151 | B2 * | 7/2012 | Drachko | 123/245 |

FOREIGN PATENT DOCUMENTS

| | | | |
|---|---|---|---|
| RU | 2146009 | C1 | 2/2000 |
| WO | WO 2009/072994 | A1 | 6/2009 |

OTHER PUBLICATIONS

International Search Report, Feb. 11, 2010, from International Phase of the instant application.
English Translation of the Written Opinion of the International Search Authority, Feb. 11, 2010, from International Phase of the instant application.
English Translation of International Preliminary Report on Patentability Chapter I, Jan. 24, 2012, from International Phase of the instant application.
English Translation of International Preliminary Report on Patentability Chapter II, Feb. 2, 2012, from International Phase of the instant application.

* cited by examiner

*Primary Examiner* — Mary A Davis
(74) *Attorney, Agent, or Firm* — Jackson Patent Law Office

(57) ABSTRACT

A "TurboMotor" positive displacement rotary-piston machine comprises a casing having an annular working chamber and intake and exhaust ports, two drive shafts coaxial with the annular surface defining the working chamber and provided with rotary pistons on one end thereof and with arms on the other end thereof, a stationary central gear coaxial with the surface defining the working chamber and with the drive shafts, an output shaft concentric with the drive shafts and having an offset portion carrying a carrier and a planetary gear, the planetary gear being in mesh with the stationary central gear the carrier being pivotally connected to the arms of both drive shafts through the connecting rods. The annular working chamber of the casing communicates with the intake ports and exhaust ports and/or exit channels and entrance channels arranged sequentially and contiguously.

10 Claims, 22 Drawing Sheets

"TURBOMOTOR" ROTARY MACHINE WITH VOLUMETRIC EXPANSION AND VARIANTS THEREOF

TECHNICAL FIELD

The claimed positive displacement rotary-piston machine can be used as an internal combustion engine and as external combustion engine, as well as a refrigerating machine, a pump or a blower of various gases and liquids.

The present invention relates to the structure of rotary-piston machines comprising a working chamber with positive displacement members of the rotary-piston machines, i.e., such as rotary pistons, plungers, cups that are disposed in one casing (stage). Their cooperative motion is implemented by a planetary train. The train provides for a mutually related and rotationally oscillatory motion of the positive displacement members of the rotary-piston machines.

The rotary-piston machines equipped with such positive displacement members, depending on any auxiliary equipment, can operate as rotary-piston internal combustion engines on any liquid and/or gaseous fuel with internal and/or external carburetion. Also, rotary internal combustion engines with such planetary kinematic trains can be used as working fluid closed-cycle rotary external combustion engines, e.g., operating on the Stirling principle (otherwise referred to as external combustion engines.

Such machines are designed for:

(a) various vehicles such as motorcars, cabs and trucks;

small-size water crafts such as motorboats, small ships, and yachts;

superlight and light aircraft such as paramotors, powered hang gliders, airplanes, and particularly light-weight helicopters;

(b) motor systems for recreational activities and leisure sports, such as motorcycles, four wheeled bikes, scooters, and snowmobiles;

(c) tractors and other farm implements, preferably for farms, and (d) compact and mobile electric generators."

Also, positive displacement rotary-piston machines with such mechanical linkages can operate as refrigerating machines, e.g., to refrigerate foodstuffs.

Furthermore, the rotary-piston machines equipped with such positive displacement members can operate as compressors, blowers of air and/or various gases, vacuum engines, and hydrotransmission devices:

(a) to fill various receivers, e.g., tires of motorcars and airplanes;

(b) to supply compressed air for various industrial applications, e.g., air tools;

(c) to evacuate air and other gases from a process equipment, e.g., vacuum furnaces;

(d) to pump liquids, e.g., in processing lines for a measured filling of containers.

As used herein:

the term "rotary-piston machine" means a machine comprising a working chamber with positive displacement members of the rotary-piston machines, i.e., such as rotary pistons, plungers, cups that are disposed in one casing (stage);

the term "rotary internal combustion engine" means an engine having at least two pairs of rotary pistons mounted on coaxial shafts disposed in at least one annular casing (stage). There can be several such casings (stages) and they can be arranged adjacent to each other;

the term "rotary pistons" means such positive displacement structural members, between which and the inner walls of one stage alternations of working fluid volumes occur;

the term "end face" means a peripheral surface of each rotary piston mating to the inner walls of the casing;

the term "side" means a side surface of each rotary piston mating on its perimeter to the inner walls of the casing;

the term "closing of sides" means a position of the sides of adjacent rotary pistons characterized by a minimum space/distance between them;

the term "working chamber" means a space confined between the inner wall of the casing and the rotary piston faces. It has at least four instant subchambers, simultaneously existing and varying in volume. In operation, the chamber of the rotary-piston machines has a constant volume independent of the angular displacement of the rotary pistons.

the term "instant subchamber" means each variable portion of the chamber, confined between the faces of neighboring rotary pistons and the inner walls of one stage and where the operating cycles take place one after another.

the term "overflow content" means a total capacity of exit and entrance (from/to the annular chamber of the casing) channels as well as spaces connectable thereto, connecting pipes included;

the term "overflow chamber" means a total capacity of exit and entrance channels of a unified embodiment;

BACKGROUND ART

Known in the art are rotary vane machines with planetary trains designed for the above-mentioned applications, e.g., by E. Kauertz, U.S. Pat. No. 3,144,007 for Rotary Radial-Piston Machine, issued 1967 (appl. Aug. 11, 1964); U.S. Pat. No. 6,886,527 ICT for Rotary Vane Motor.

Such machines are also disclosed in German Patent No. 142119 issued 1903; German Patent No. 271552 issued 1914, cl. 46 a6 5/10; French Patent No. 844 351 issued 1938, cl. 46 a5; U.S. Pat. No. 3,244,156 issued 1966, cl. 12-8.47 and others. Mechanisms and machines for similar applications are disclosed in Russian Patent No. 2 013 597, Int. cl.$^5$ F02B 53/00; Russian Patent No. 2 003 818, Int. cl.$^5$ F02B 53/00; Russian Patent No. 2 141 043, Int. cl.$^6$ F02B 53/00, F04C 15/04, 29/10, issued 1998; Ukrainian Patent No. 18 546, Int. cl. F02B 53/00, F02G 1/045, issued 1997.

Similar structure is disclosed in U.S. Pat. No. 6,739,307, US Cl. 123/245, issued May 25, 2004 for Internal Combustion Engine and Method to Ralph Gordon Morgado.

Planetary trains used in the prior-art machines provide for mutual and relative rotationally-oscillatory movement of their compression members such as rotary pistons. However, in prior-art rotary-piston machines, all thermodynamic processes occur between the positive displacement members, fuel combustion included. This results in losses of heat into the walls with lesser temperature and in a high heat load within the working chamber of the casing and the positive displacement members. As a result, dependability of rotary-piston machines becomes worse and their useful life decreases. Also, it is difficult to ensure optimal—close to spheroidal—compact shape of the combustion chamber in such rotary-piston machines structurally. Furthermore, it is practically impossible to optimally arrange the spark plug within the combustion chamber to minimize the time of flame front spread. The spark plug has to be placed at the edge of the combustion chamber near the wall of the working chamber.

The prior-art rotary-piston machines with positive displacement members have the following common structural features:

a casing having an annular chamber and an intake port and exhaust port;

at least two pairs of rotary pistons fixed on two drive shafts coaxial with the annular surface defining the chamber, and at least one of the drive shafts having a crank;

an output shaft coaxial with the drive shafts and having a carrier, at least one external planetary gear meshed with a stationary central gear coaxial with the surface defining the chamber and with the drive shafts;

crankshaft(s) coaxial with the planetary gear;

connecting rods pivotally linking the arms of the drive shafts and crankshafts of the planetary gears.

A disadvantage of such engines resides in the fact that the chamber defined by rotary pistons is of a final volume and hot burnt gases remain there after the exhaust stroke is completed. This impairs usage of the working chamber capacity for clean air and/or the next air-fuel mixture and worsens power characteristics of the engine.

A further disadvantage resides in the fact that additional equipment is required to initiate the cyclic ignition of the air-fuel mixture at each running cycle to be strictly synchronized with the phases of the work of the kinematic mechanism of the rotary-piston machine. This is a factor that complicates the engine and decreases its operational reliability.

Known in the art are gasoline engines with precombustion chambers to ensure a combination of precombustion chamber ignition and torch ignition of very thin mixtures [1]. In this case the precombustion chamber communicates with the cylinder via a channel. Use of precombustion chambers provides for complete combustion of the fuel and enhancement of the engine efficiency at lower peak temperatures in the cylinder, the major drawback being a complicated fuel-supply system.

Also known in the art are diesel engines having separate combustion chambers—precombustion chambers and swirl combustion chambers [2]. These chambers communicate with the cylinder through one or several channels to provide for a bidirectional flow of working fluid. In such engines, the air-fuel mixture is highly turbulized to form a thoroughly mixed charge and get a complete combustion of the fuel even under moderate pressures of the fuel injection. However, due to an increase in heat losses, the efficiency of the engines with separate combustion chambers is rather low compared with the engines where combustion chambers are not separated.

The closest prior art is disclosed in WO/2009/072994 published Nov. 6, 2009; (Int. Appl.: No. PCT/UA2007\000080; F01C 1/063, F02B 53/00, F04C 2/063; POSITIVE EXPANSION ROTARY PISTON MACHINE, inventor DRACHKO, Yevgeniy Fedorovich, UA).

This is a rotary-piston machine with a planetary mechanism capable of various gear ratio transmissions, namely, $i=n/(n+1)$, where $n=1, 2, 3, 4$ and so on, for various uses (for example, as engines and compressors).

This machine, in particular, comprises a casing having an annular working chamber and an intake port and exhaust port, as well as:

at least two drive shafts coaxial with the annular surface defining the working chamber and provided with pistons on one end thereof and with arms on the other end thereof, at least one stationary central gear coaxial with the surface defining the working chamber and with the drive shafts, an output shaft concentric with the drive shafts and having a carrier, crankshafts connected to the arms of the carrier of the output shaft and carrying planetary gears meshed with the stationary central gear, connecting rods linking the arms of the drive shafts and crankshafts, and the output shaft having an offset portion carrying the carrier and a planetary gear, the planetary gear being in mesh with the stationary central gear on the internal teeth thereof, the carrier is pivotally connected to the arms of both drive shafts through the connecting rods.

Engines built on the concept of such rotary-piston machine suffer from a number of drawbacks.

First, to keep cyclically igniting the fuel, additional equipment is required, such as a fuel pump and high-pressure nozzles where there are the diesel cycle or spark-plug ignition in a gasoline engine implemented. The necessity of ideal synchronization of operation of the system components with kinematics of the engine is peculiar to both the diesel fuel-supply system and ignition systems of a gasoline engine. Even small deviations in the operation of synchronization systems from optimum conditions (for some reason or other) substantially impair operational characteristics of the engines. In many cases of running engines, synchronization disturbances are the cause of a malfunction.

Second, combustion takes a long time compared to maximum compression phase when the fuel is ignited cyclically. This phenomenon mostly shows up at maximum revolutions. To overcome the phenomenon, use is made of conventional methods of intensifying combustion in piston engines (e.g., turbulization of the air-fuel mixture). The point is that at high revolutions, the fuel has no time to fully combust between the rotary pistons under maximum compression. This reduces the engine efficiency and environmental safety.

Third, the fuel ignition and combustion (at a temperature about 2000° C.) takes place in the working chamber having "cold" walls (with a temperature about 300° C.) and the working chamber having walls and rotary pistons undergo a high thermal load due to a big difference between the temperatures. For this reason a large amount of heat energy is lost and the engine would require intensive heat removal (i.e., a cumbersome and complicated cooling system would be required). This complicates the engine and impairs its efficiency.

From the aforesaid it will be obvious that the drawbacks of the prior-art engine stem from its design features and the nature of its operation, notably cyclic ignition from a high-temperature point source of heat (0.6-0.8 mm interelectrode space of a spark plug) for a gasoline engine;

cyclic ignition from a low-temperature spatial source of heat (compression ignition of diesel fuel) for an internal mixture formation;

fuel ignition and combustion in the engine working chamber between the sides of the rotary pistons.

DISCLOSURE OF THE INVENTION

This invention has for its object to enhance the efficiency and operational reliability as well as widening the scope of application of rotary-piston machines.

A possible way to overcome the aforesaid drawbacks of prior-art rotary-piston machines is to take the high-temperature zone of fuel combustion with reliable ignition from a high-temperature spatial source of heat out of the working chamber.

This objective is accomplished by providing a positive displacement rotary-piston machine comprising:

a casing having an annular working chamber and intake and exhaust ports, at least two drive shafts coaxial with the annular surface defining the working chamber and provided with rotary pistons on one end thereof and with arms on the other end thereof, at least one stationary central gear coaxial with the surface defining the working chamber and with the drive shafts, an output shaft concentric with the drive shafts and having an offset portion carrying a carrier and a planetary gear, the planetary gear being in mesh with the stationary central gear on the internal teeth thereof with a gear ratio $i=n/(n+1)$, where $n=1, 2, 3, 4, 5 \ldots$, i.e. a series of integers), the carrier being pivotally connected to the arms of both drive shafts through the connecting rods, and the number of the rotary pistons mounted on each drive shaft being $n+1$, characterized in that the annular working chamber of the casing has intake ports and exhaust ports and/or exit channels and entrance channels to pass overflow content(s) carried out beyond the annular working chamber, the ports and channels being sequentially and contiguously connected to the annular working chamber of the casing in the same direction as the rotary pistons move, the intake ports and exhaust ports as well as the exit channels and entrance channels being arranged on each side of the site where the sides of the rotary pistons close, and the sides of the rotary pistons in themselves having an angular width sufficient to simultaneously shutdown the exit channel and entrance channel.

Unlike the prior-art machines, the invention provides for:

(a) the development of some operation phases of functionally various rotary-piston machines, such as internal combustion engines, external combustion engines, refrigerating machines, compressors, and vacuum engines, outside of the working chamber. With rotary-piston internal combustion engines, it is very important that the working fluid be outside of the working chamber when heat is supplied thereto through exit and entrance channels. This allows temperature and pressure peak values outside of the working chamber. As a result, the thermal load on the casing and rotary pistons is reduced.

(b) a reduction of peak mechanical loads (as a result of the peak working fluid pressure) on the kinematic links of the rotary pistons drive mechanism.

(c) a good dispersion of the fuel and a fast and effective mixing thereof with air while injecting the air-fuel mixture from the working chamber into the overflow/combustion chamber.

(d) a trouble-free synchronization of the air-fuel mixture ignition with optimized position stages of the positive displacement members, namely, rotary pistons without recourse to any additional devices.

(e) a trouble-free air-fuel mixture ignition from a high-temperature gas and the walls of the overflow/combustion chambers regardless of the fuel grade used.

(f) a high rate and completeness of fuel combustion at an excess of air and maximum compression ratio.

(g) carrying out the invention without a complication to the rotary-piston machine with a simultaneous increase in efficiency and reliable performance.

In the general case, the inventive structure provides for:

optimized conditions for the operation of rotary-piston machines of various applications (with rotary-piston internal combustion engines, it means the full admission of the air-fuel mixture/air to the working chamber, trouble-free ignition and complete combustion of the fuel with minimal heat transfer to the walls);

a reduction in a heat load both on the working chamber of a rotary-piston machine and rotary pistons;

a reduction in a mechanical load on the kinematic links of the rotary pistons drive mechanism;

a design simplification and operational reliability improvement of a rotary-piston machine as well as widening its scope of application.

Particularly with rotary-piston internal combustion engines these objectives are accomplished by way of:

(a) more efficient removal of exhaust gases from the working chamber as the sides of the rotary pistons close and subsequent transfer of the working fluid to the overflow/combustion chambers to apply heat;

(b) a cyclic injection of highly turbulized air and/or the air-fuel mixture via the exit channels to provide for its uniformity and subsequent fuel combustion;

(c) cyclic isolation/closing of the exit and entrance channels with the end faces of the rotary pistons, while the fuel is burning. Peak mechanical loads from peak pressures in the exit and entrance channels compensate each other immediately on the opposing end faces of the rotary pistons—since these channels are arranged on the opposing sides with respect to the working chamber and working shafts. In this case, there is a substantial decrease in mechanical loads on the kinematic mechanism of a rotary-piston internal combustion engine and reliable performance thereof accordingly.

(d) a persistently high temperature in the overflow/combustion chambers. This is essential to accelerate physical and chemical processes of vaporization, ignition, and combustion of a subsequent fuel feed regardless of its grade.

(e) all-time excess pressure in the exit and entrance channels and in the overflow/combustion chambers as a whole. Consequently, the remainder of the working fluid has heightened density and heat capacity therein, thus contributing to short heat transfer to the next fuel feeds and expedited pre-combustion and oxidation reactions.

(f) the possibility of fuel combustion at an excess of air due to a persistently high temperature and excess pressure in the exit and entrance channels. This is beneficial on the one hand as ignition reliability and effective combustion and, on the other hand, as lower peak temperatures and pressure in the exit and entrance channels. It is significant for reliable operation of a rotary-piston internal combustion engine, its efficient and environmentally safe operation.

With a rotary-piston internal combustion engine, the foregoing taken together provides (a) widening the scope of use of the engine by way of easing the limitations to the fuel used, namely, various grades of gasoline, diesel fuel, biofuel, aviation kerosene, natural gas etc.

(b) reliable operation and good economic efficiency owing to good usage of working chamber capacity, a high rate and completeness of fuel combustion under a high pressure and an excess of fuel in high-temperature overflow/combustion chamber.

(c) a decrease in mechanical as well as thermal loads on the kinematic links and systems of the engine, for example, the systems of cooling and lubrication.

(d) the design simplification of the engine and its operational reliability improvement, what is the solution of the problem in whole.

The first additional difference from the aforesaid consists in that the exit channels and entrance channels are formed as overflow chambers. This lifts restrictions on optimizing the shape of an overflow chamber and enables an optimal positioning of the spark plug/injector therein.

Another additional difference consists in that the overflow chambers are mounted on hermetic heat-insulation gaskets, wherein both the walls of the overflow chambers and the walls of the exit channels and entrance channels may be lined with a highly porous gas-permeable and heat-resistant ceramic material. This provides for a substantial decrease in heat transfer from heated walls of the overflow chambers to the casing and allows a decrease in its thermal stress.

In this case, the highly porous gas-permeable and heat-resistant ceramic material, e.g., silicon carbide, with a sufficiently developed surface area and good gas-permeability, has a big mass and correspondingly high heat capacity as compared with a gaseous medium. This ensures fast and effective heat transfer to the fuel from the ceramic material heated in previous running cycles. Reliable ignition and fast combustion of fuels of various grades is thus ensured.

At the rated speed of a rotary-piston internal combustion engine, the time of injecting the air-fuel mixture (in case of an external charge mixing) into the overflow chamber becomes shorter, due to structural variations, e.g., off-centering the overflow chambers, than the delay of firing. There will not be therefore a backflow of the working fluid. The fuel, being enclosed within an already closed overflow chamber under a high temperature, is evaporated, reliably ignited, rapidly and completely burnt with an excess of air and under the highest possible pressure.

Also, the highest possible pressure and temperature in the overflow chambers is achieved when the chambers are closed with the end faces of the rotary pistons with the sides thereof being closed. Here, there is no need for any devices to synchronize ignition of the air-fuel mixture and to attain the maximum compression, allowing thereby a simpler design and operational reliability of the engine.

The overflow chambers may be provided with gas-tight inserts to preclude the flow of gas at the angular joint of the sides and end faces of the closed rotary pistons, thus providing for the closest contact of the air-fuel mixture with the ceramic material. At the same time, the inserts serve as a short-time isolation means for the closed sides of the rotary pistons from the peak pressure and temperature within the overflow chambers. This decreases mechanical and heat loads on the kinematic mechanism of a rotary-piston internal combustion engine and the engine reliable performance is enhanced.

Yet another additional difference consists in that the annular working chamber of the casing is toroidal.

This provides for a decrease in the number of angular joints between the sealing members of the rotary pistons where use is made of compression rings. Leakage of the working fluid is consequently diminished and sealing on the whole is simplified.

Still another additional difference consists in that the positive displacement rotary-piston machine has a common output shaft with at least two offset portions as well as at least two-stage annular working chamber. Both the stages of the annular working chamber and the offset portions can be set at an angle up to 180°. The angle is to be determined by designers depending on the operational conditions and requirements for the positive displacement rotary-piston machine.

Such positive displacement rotary-piston machine, generally used as a rotary-piston internal combustion engine, can develop a torque without a negative constituent and without large changes. In operation, the engine undergoes a lower vibration level when it picks up a load. This is beneficial to the engine's reliable performance and useful life.

A further additional difference consists in that the positive displacement rotary-piston machine comprises a geared power take-off shaft coaxial with the output shaft and carrying a gear wheel in mesh with an intermediate gear wheel positioned on the planetary gear.

This embodiment provides not only for variations in torque and revolutions of the power take-off shaft. It also enable the shaft to reverse its rotation. In this way, the scope of application of the positive displacement rotary-piston machine is widened.

One more additional difference consists in that exit channels are connected through branch pipes to the inlet of the heater and the entrance channels are connected to the outlet of the heater, the intake ports being connected to the outlet of the cooler and exhaust ports being connected to the inlet of the cooler.

Separate exit and entrance channels enable heat supply outside of the working chamber and to secure the operation of an external combustion engine regardless of the fuel grade and its state. In this case, the fuel combustion can be constant without any limitations on a cyclic recurrence. In this embodiment, both the inserts and exit and entrance channels can be arranged in the casing to substantially simplify the design and to provide for reliable performance.

This enables the positive displacement rotary-piston machine to run as a working fluid closed-cycle rotary external combustion engine, operating on the Stirling principle with an external heat supply. As a result, practically any heat (fuel) source can be used to produce mechanical energy. Thus, the scope of application of the positive displacement rotary-piston machine is substantially widened.

Still further additional difference consists in that there is a thermostatic throttle included between the outlet of the radiator and the entrance channels of the positive displacement rotary-piston machine.

This enables the positive displacement rotary-piston machine to operate as a working fluid closed-cycle refrigerating machine where mechanical work of the rotating shaft is converted into a temperature difference and a corresponding supply/removal of heat to/from the evaporator and radiator to thereby widen the scope of the machine application.

Still another additional difference consists in that the exit channels are connected to the input manifold and the entrance channels are connected to the output manifold.

Such positive displacement rotary-piston machine may be used both as a compressor to compress various gases and as a vacuum engine to withdraw various gases from closed containers. This widens the scope of the machine application.

One more additional difference consists in that the rotary pistons have elastic gas-tight and moistureproof inserts and/or hermetic voids with a resilient wall Such positive displacement machine is used, as a rule, as a positive-displacement blower of liquids or gases. This widens the scope of the machine application.

A simpler design and reliable performance of rotary-piston machines as engines are the result of heat supply to the working fluid outside of the working chamber through integrated exit and entrance channels shaped as overflow chambers. In such an embodiment, the conditions for reliable ignition and effective combustion of fuels under maximum compression and without special devices for synchronizing the fuel ignition time with respect to the phases of the kinematic mechanism of the positive displacement rotary-piston machine.

Widening the scope of application of rotary-piston machines is also attainable by means of exit and entrance channels so that separate phases of operation of rotary-piston machines of various applications take place outside the working chamber of such machines as engines, refrigerating machines, blowers (compressors), vacuum engines.

BRIEF DESCRIPTION OF THE DRAWINGS

The above as well as other advantages and features of the present invention will be described in greater detail according to the preferred embodiments of the present invention in which:

In the drawings, diagrams illustrate:

in FIG. 1, a longitudinal sectional view of the rotary-piston machine with a planetary train, used as a rotary internal combustion engine;

in FIGS. 2-10, the planetary train with the gear ratio i=3/4 at various angular positions of the pistons and the links of the kinematic chain in dependence of the actual position of the offset portion on the output shaft, namely:

Figure 1:
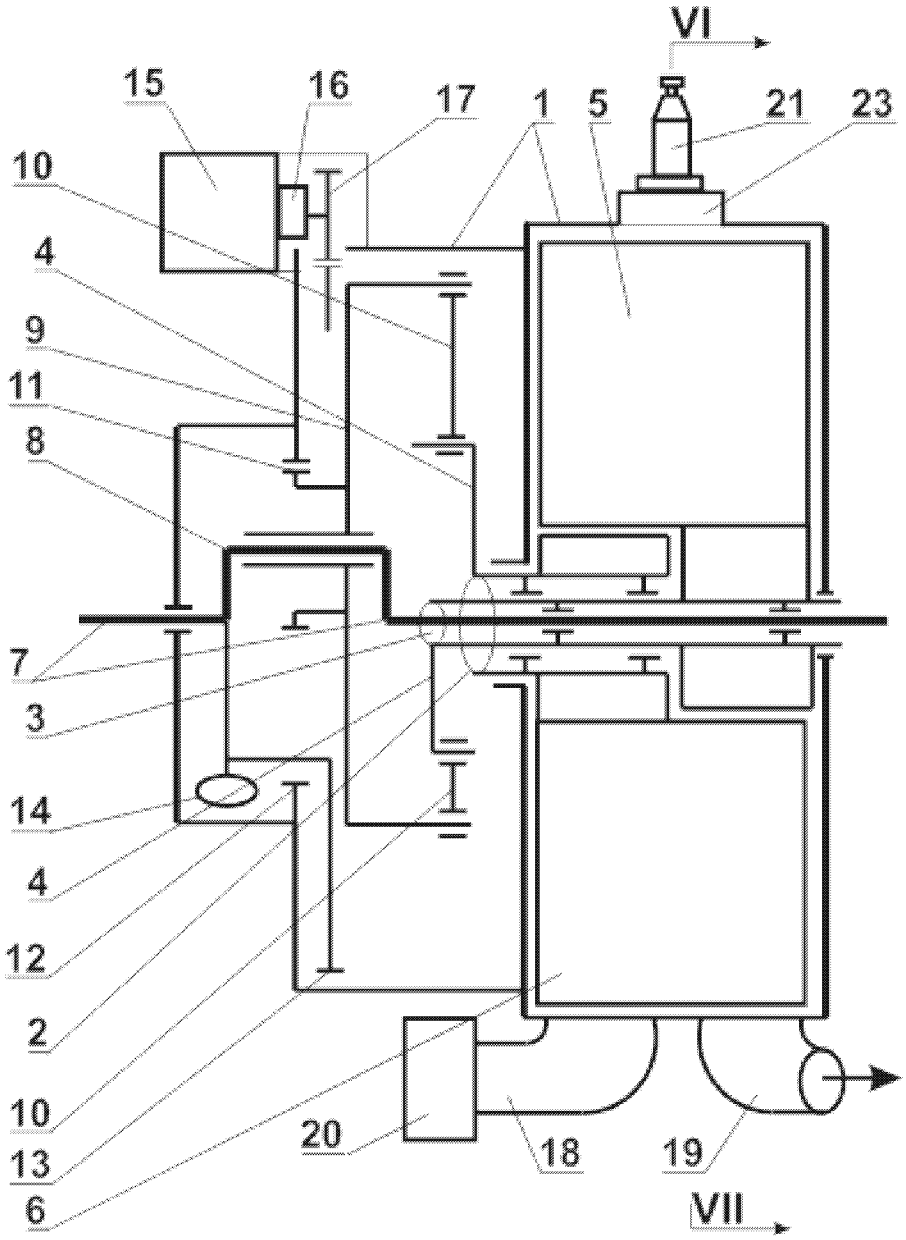
FIGS. 1-10, 24-28, 31-36, 41-45 illustrate the rotary-piston machine with a planetary train providing the gear ratios i=3/4 (generally i=n/(n+1) (where n=1, 2, 3, 4, etc.) as the basis of the positive displacement rotary-piston machine intended for various applications (e.g., engines, refrigerating machines, compressors, vacuum engines)
Figure 2:
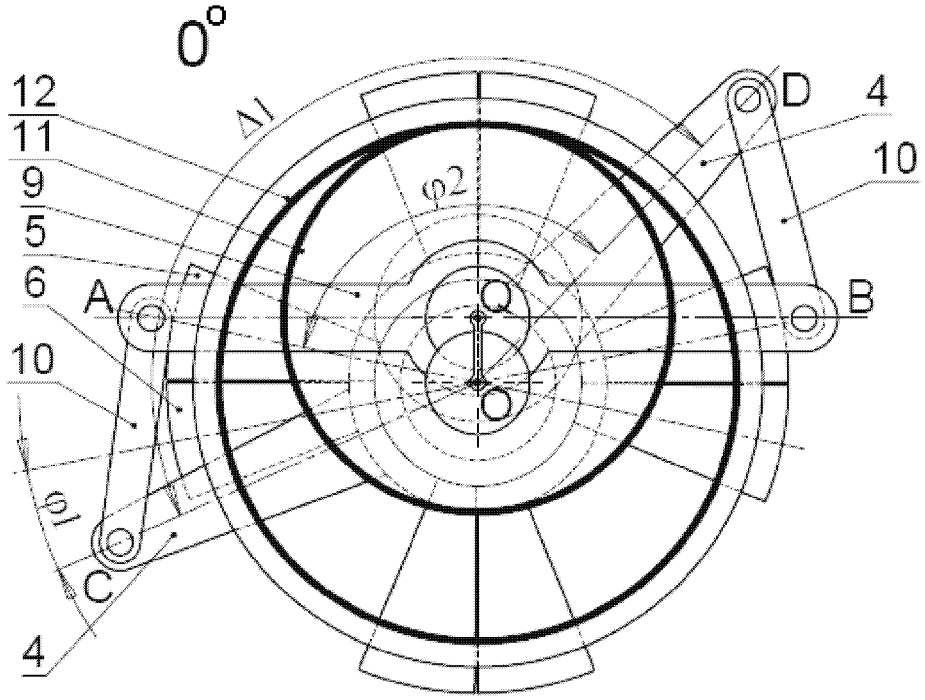
Figure 3:
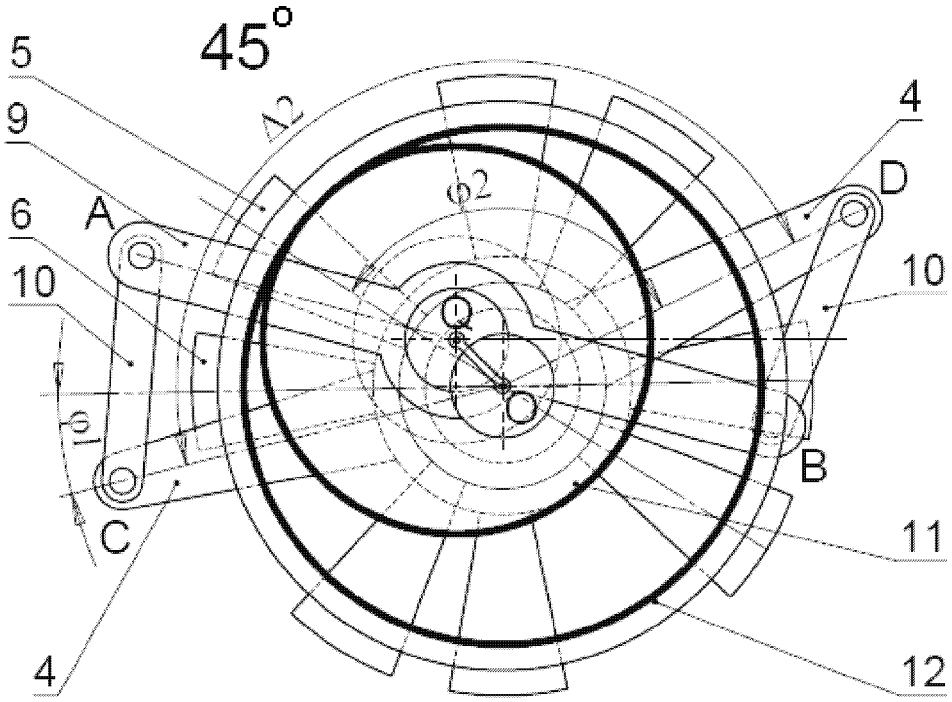
Figure 4:
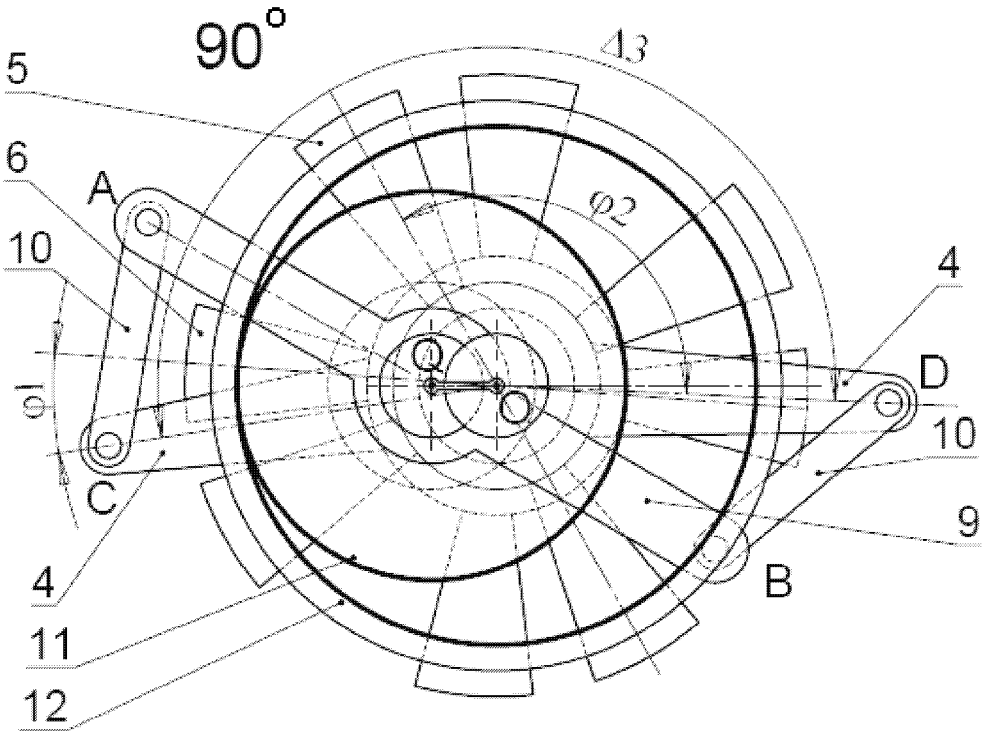
Figure 5:
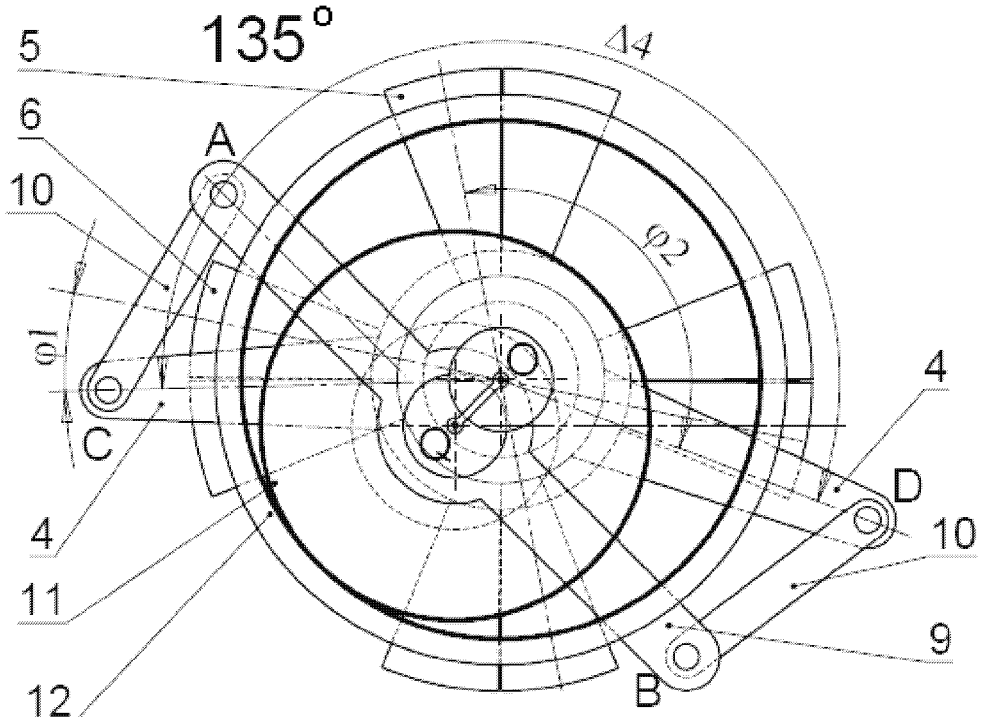
Figure 6:
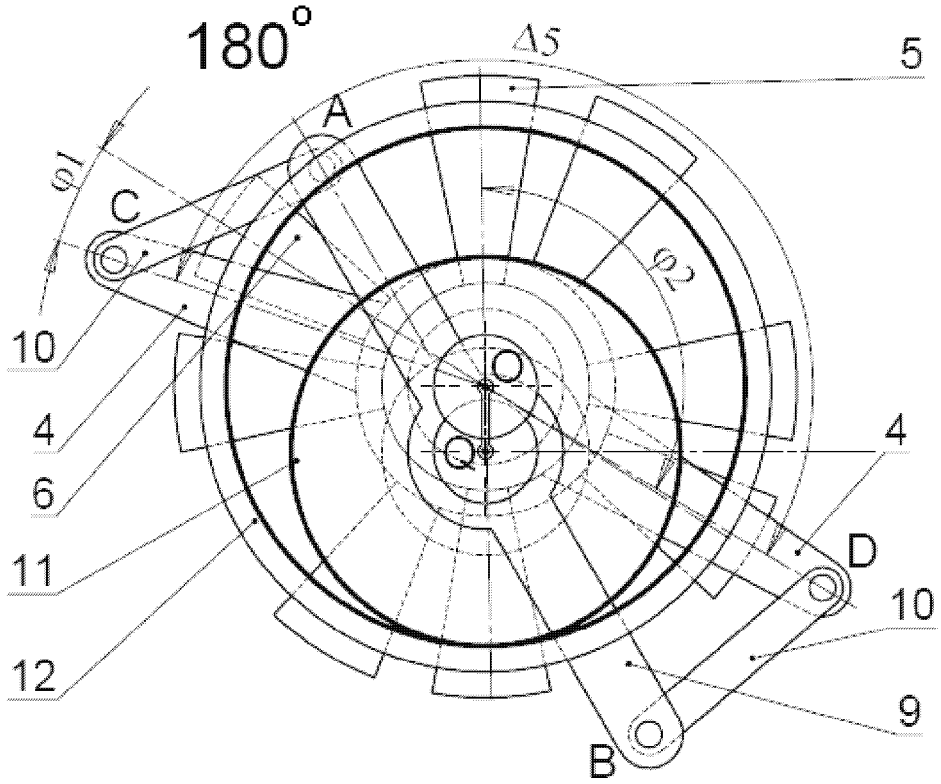
Figure 7:
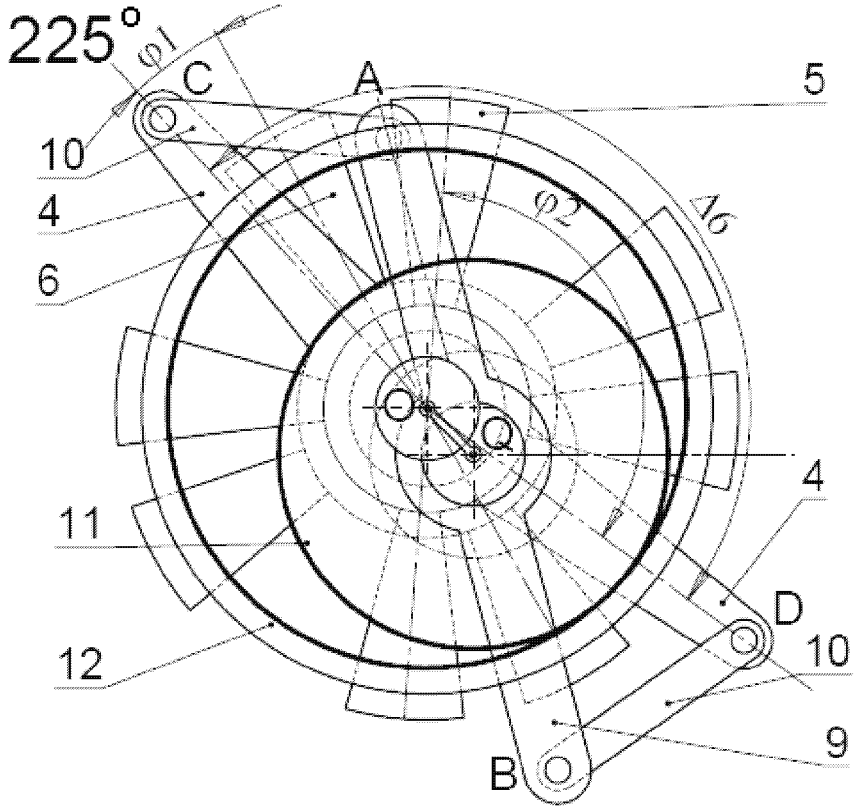
Figure 8:
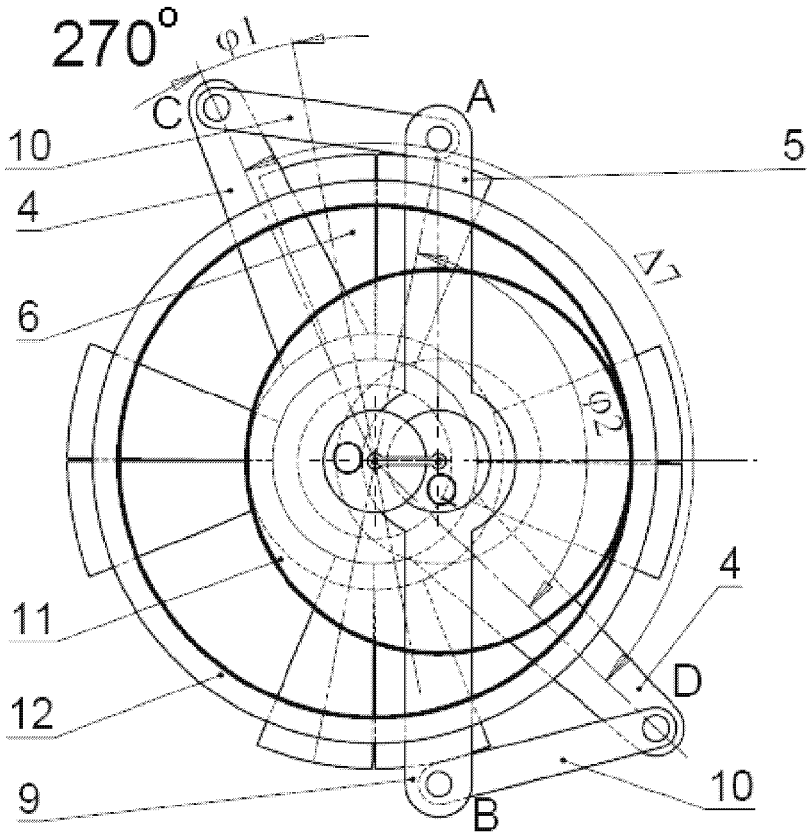
Figure 9:
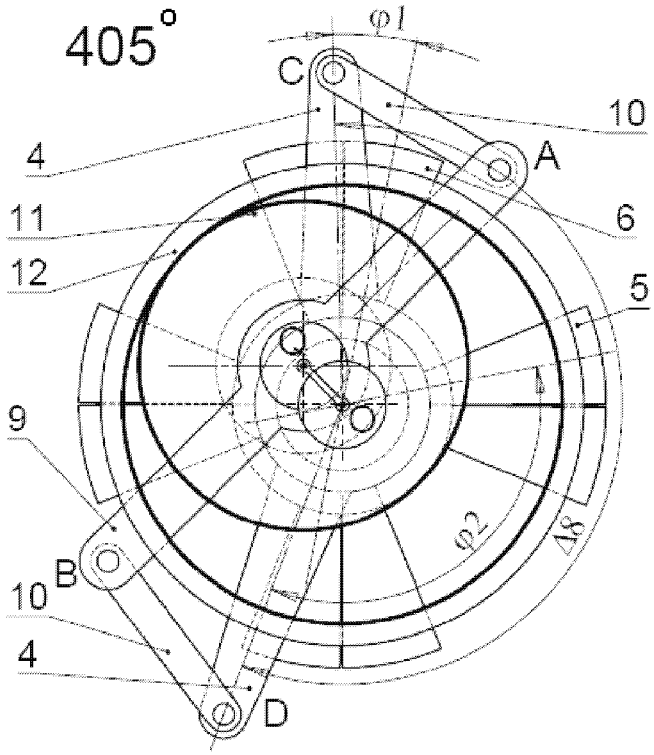
Figure 10:
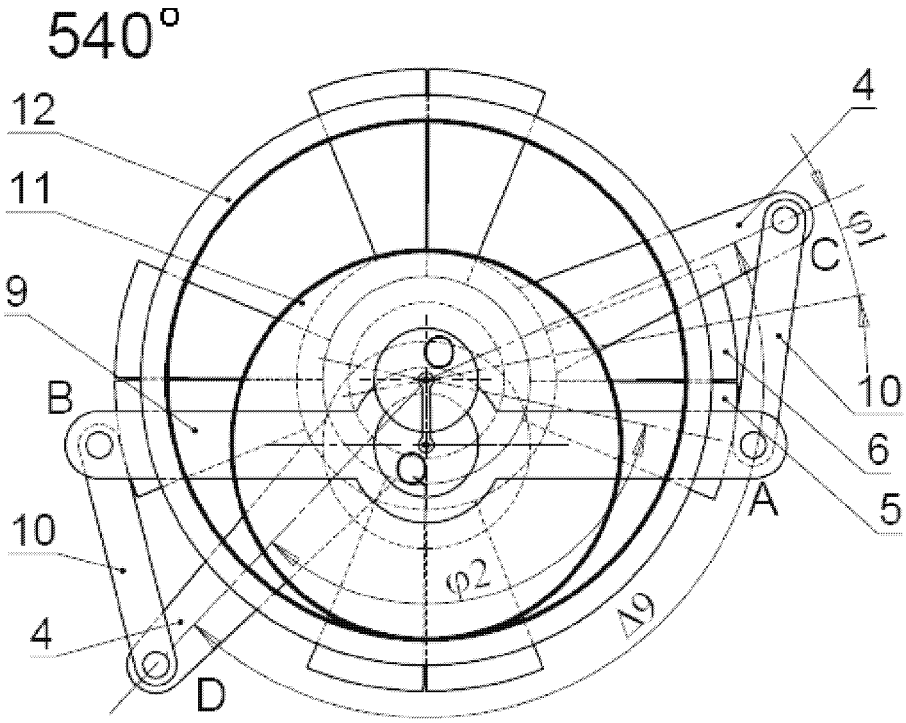
Figure 11:
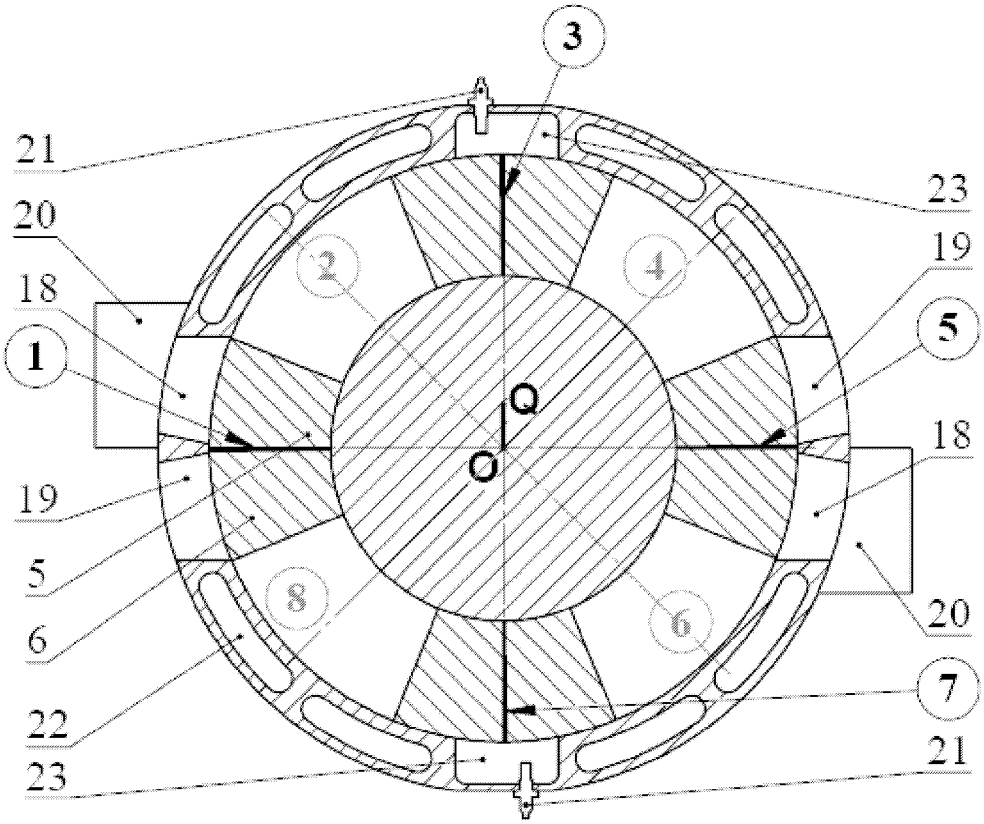
FIGS. 11-23, 29-30, 37-40 illustrate various the rotary-piston machines and their operation with characteristics.
Figure 12:
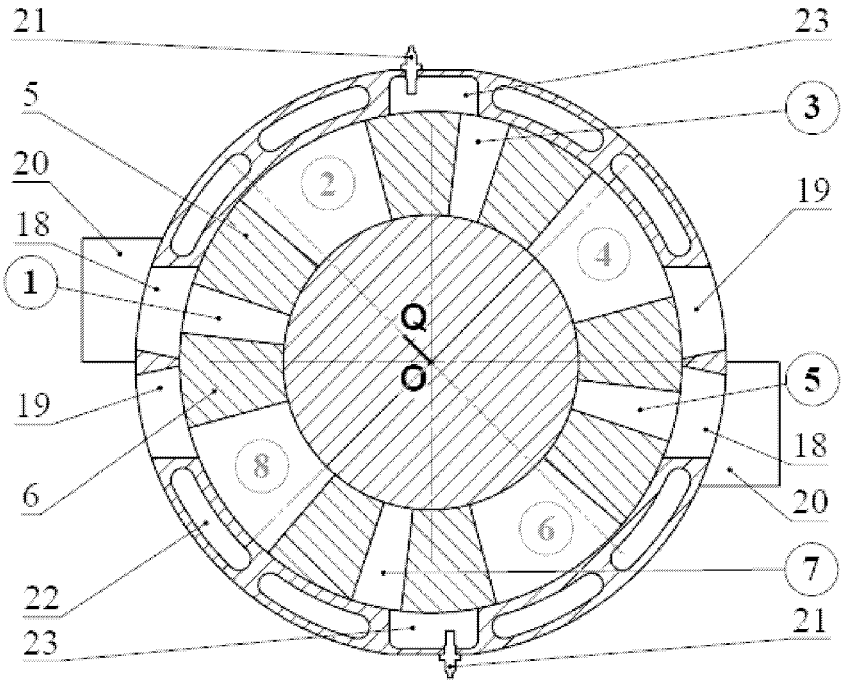
Figure 13:
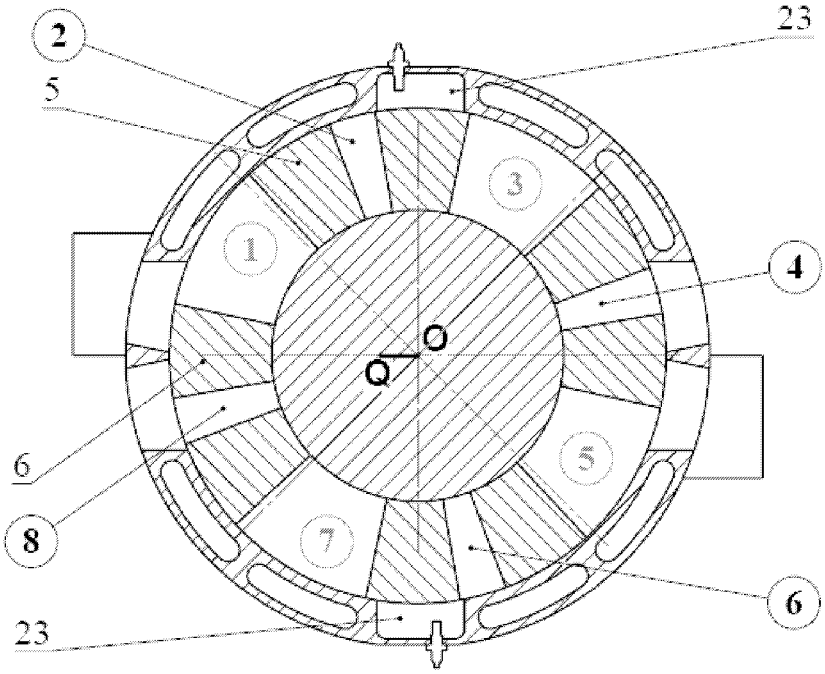
Figure 14:
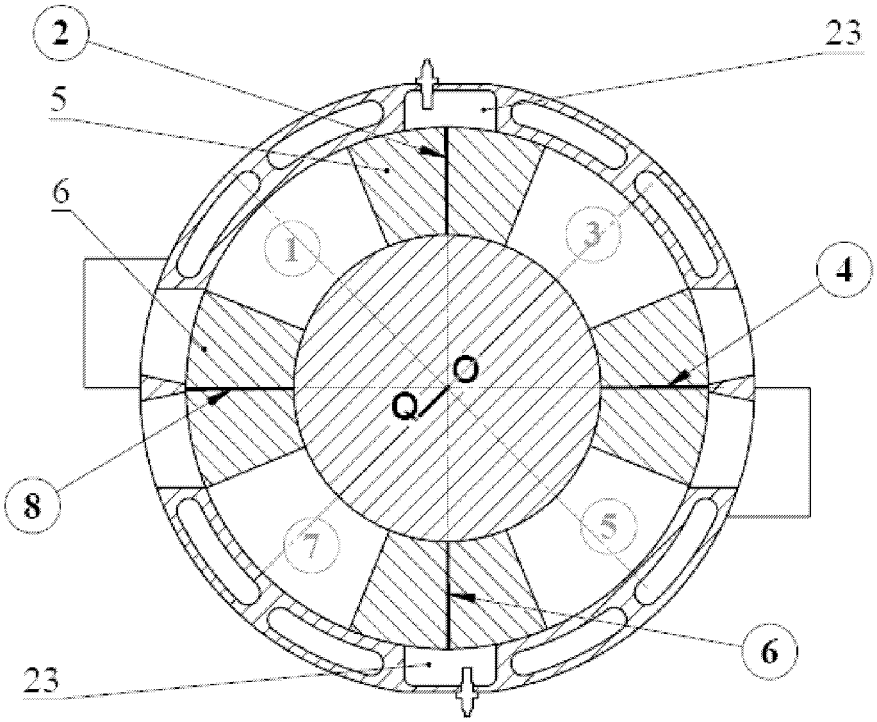
Figure 15:
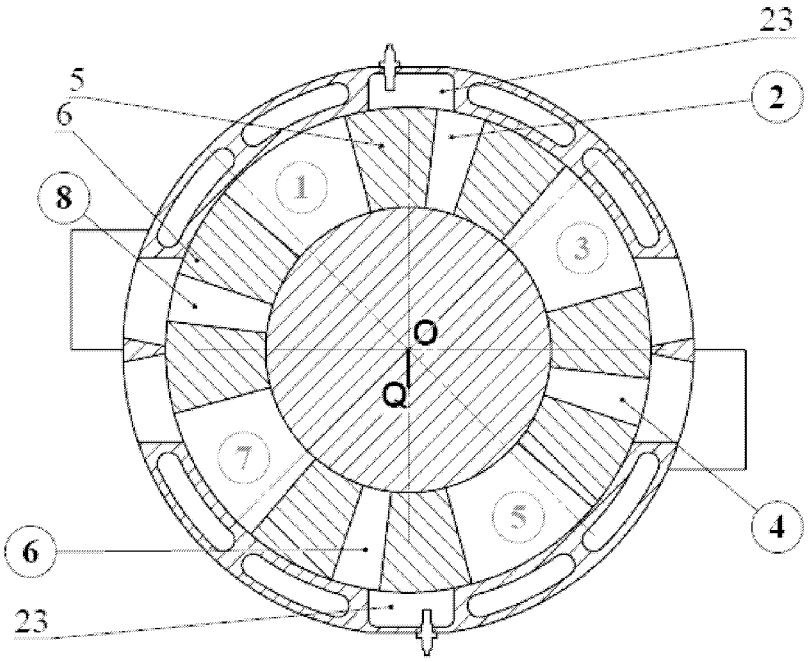
Figure 16:
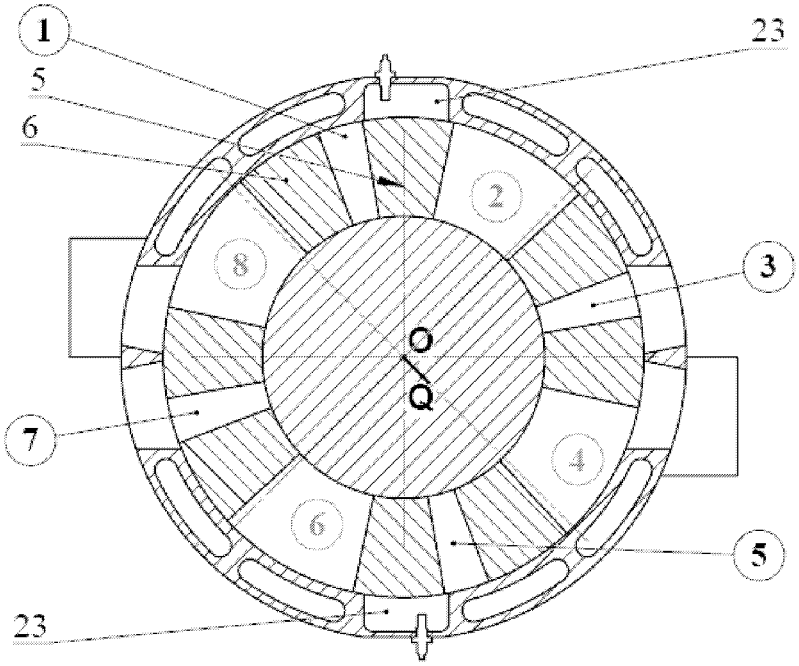
Figure 17:
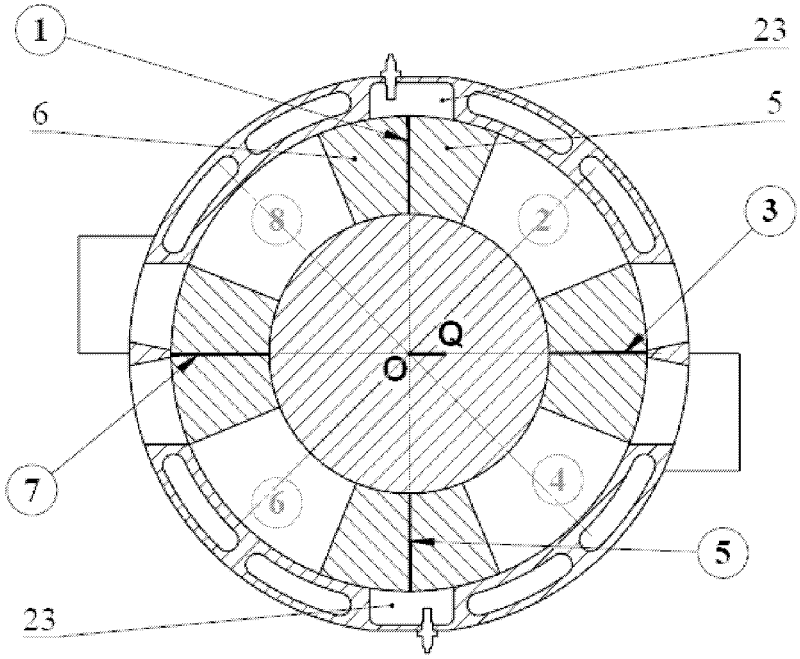
Figure 18:
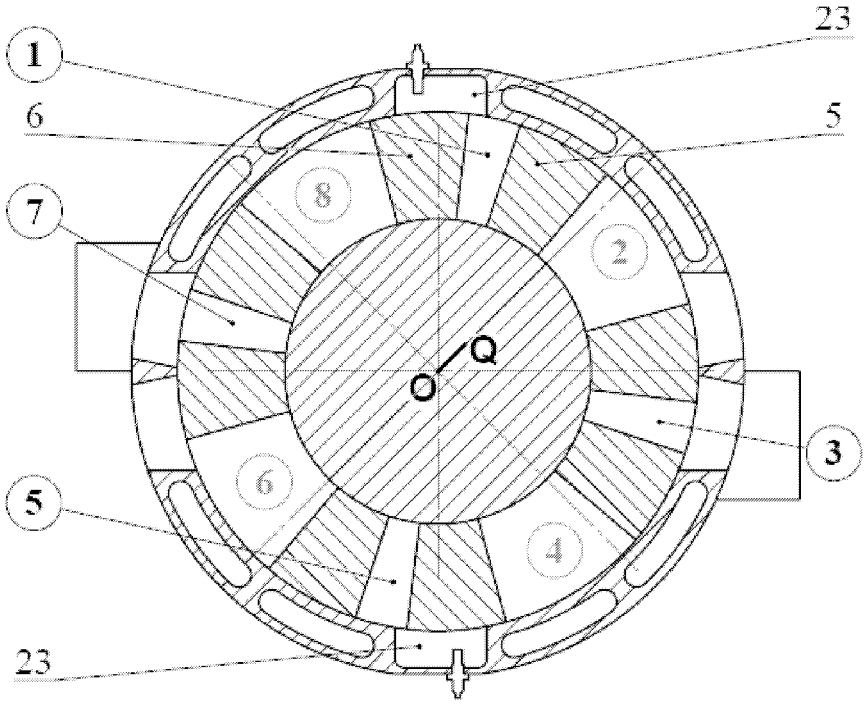
Figure 19:
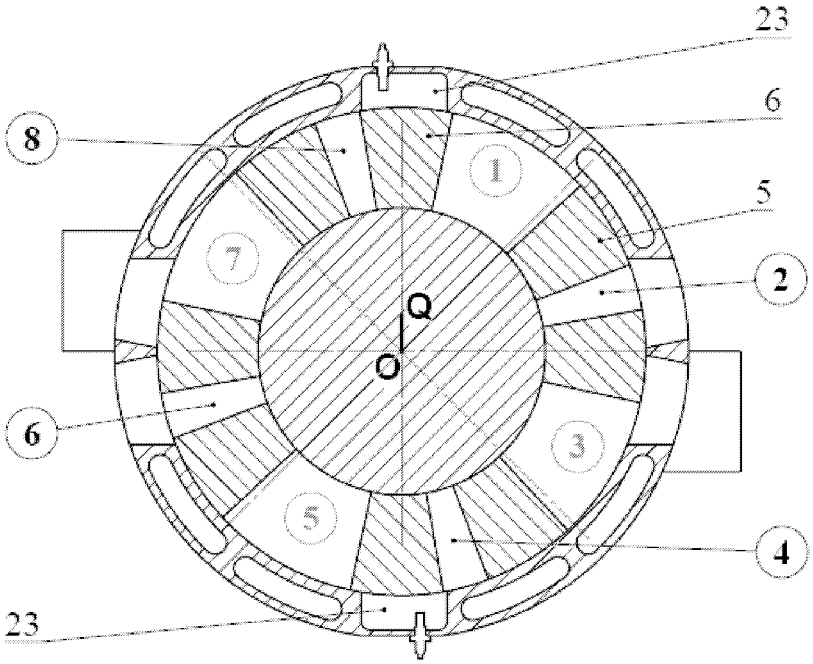
Figure 20:
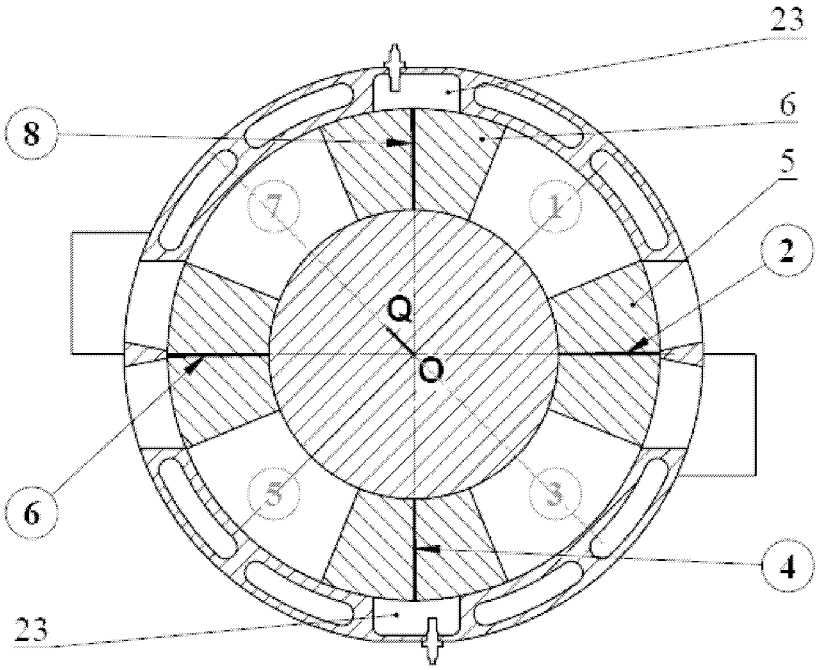
Figure 21:
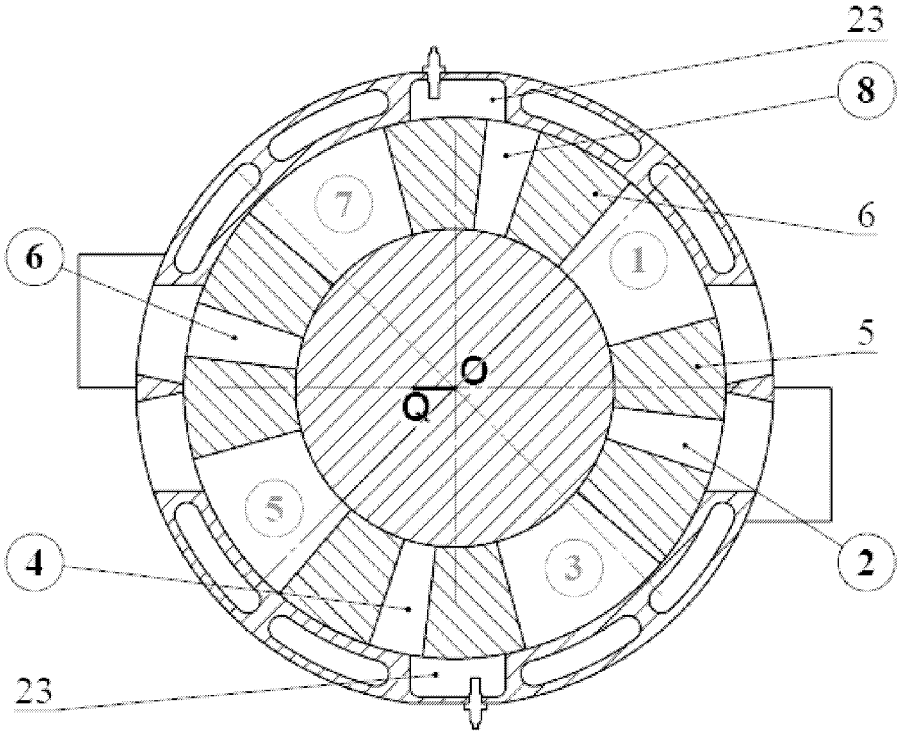
Figure 22:
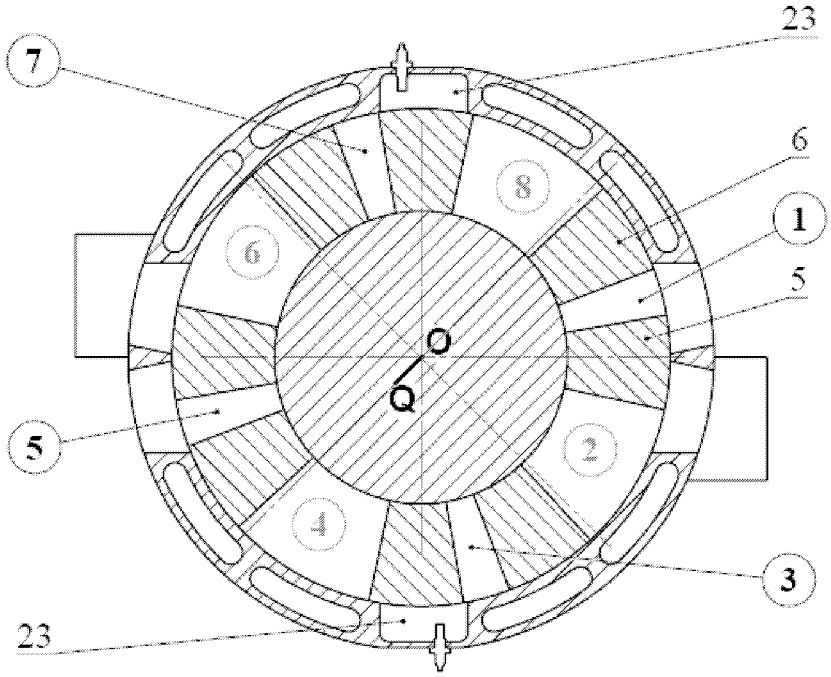
Figure 23:
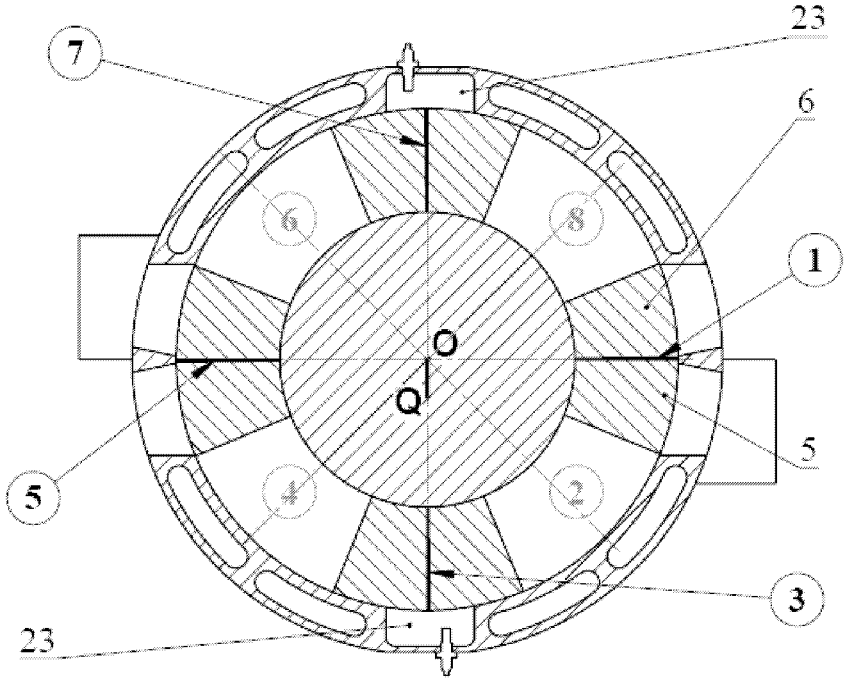
Figure 24:
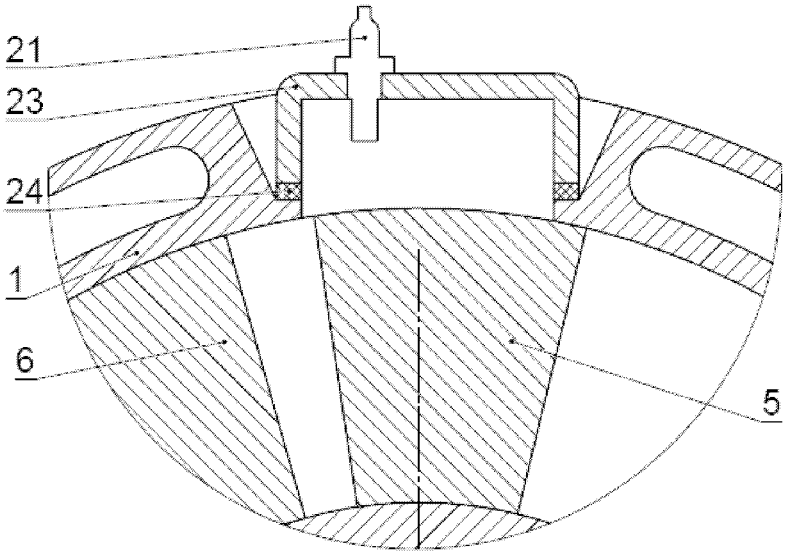
Figure 25:
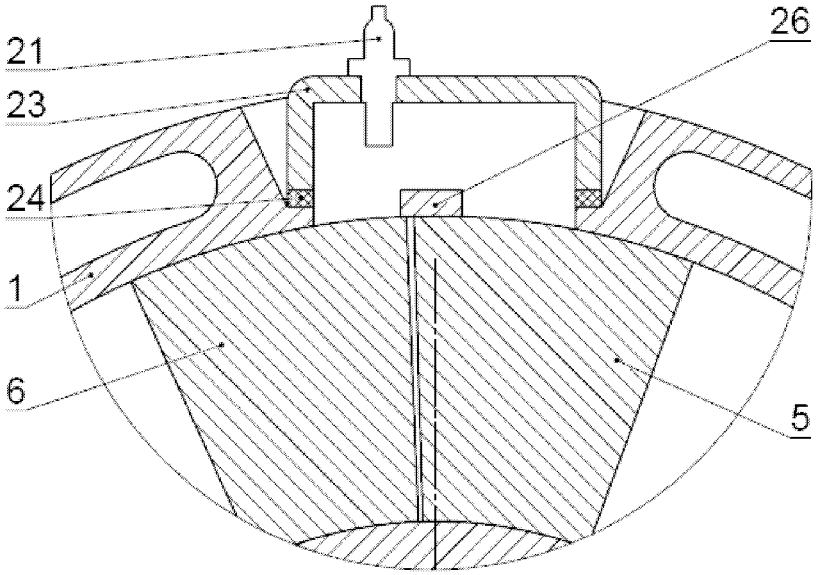
Figure 26:
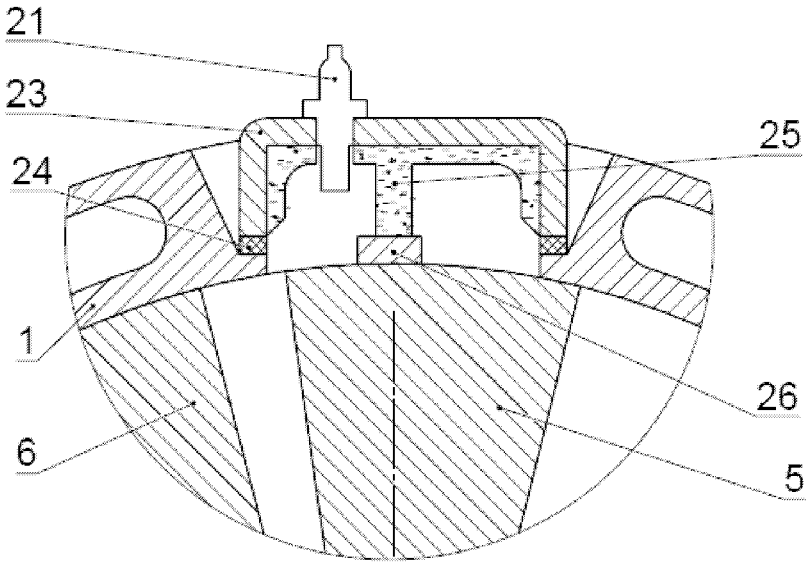
Figure 27:
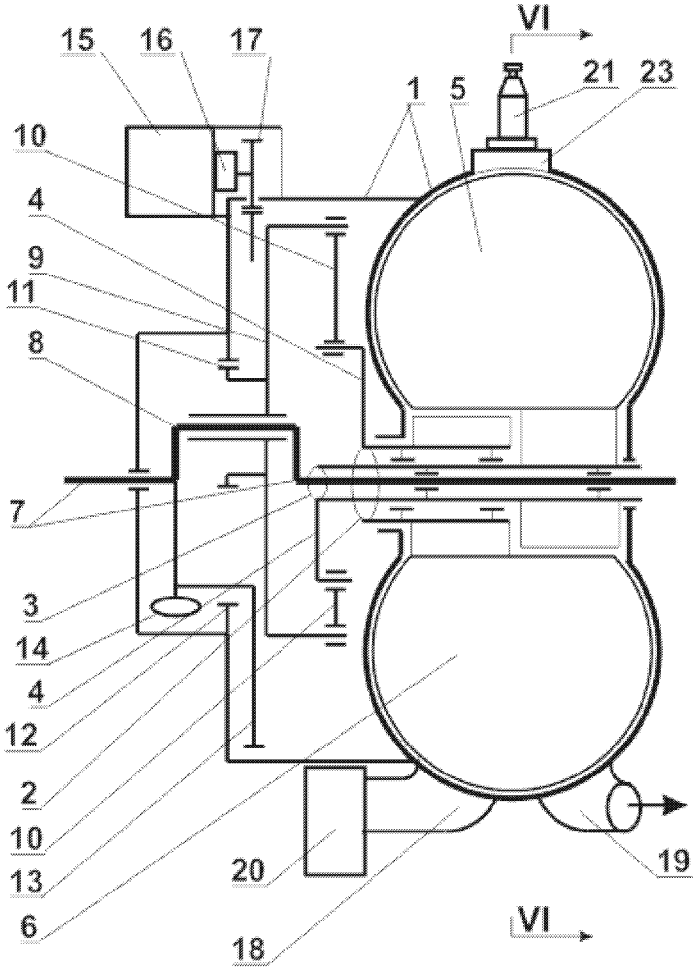
Figure 28:
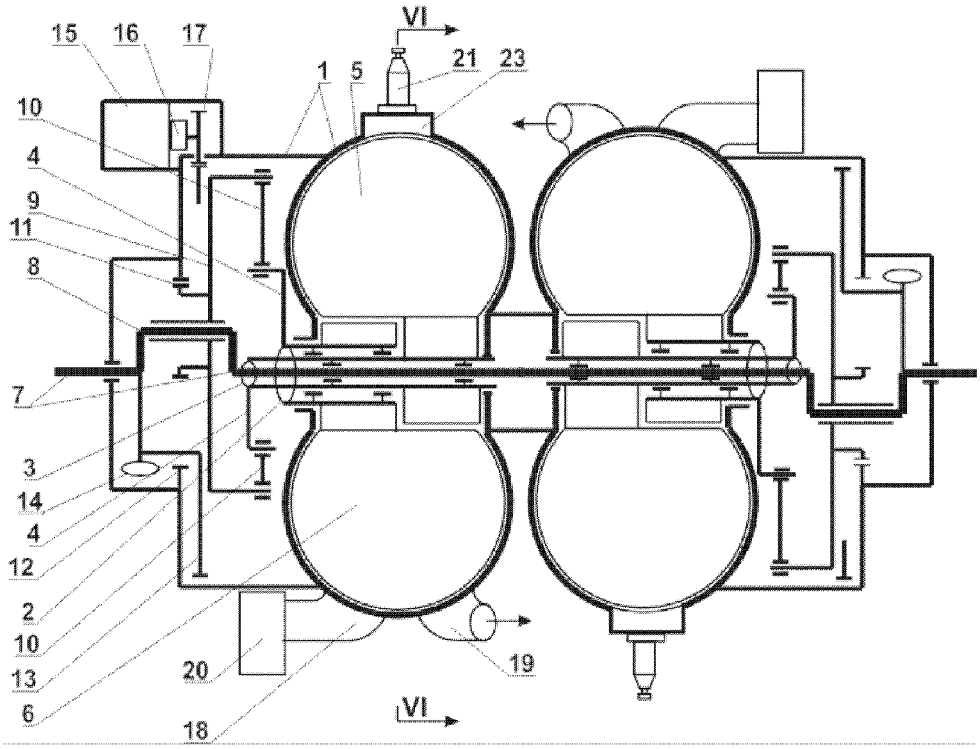
Figure 29:
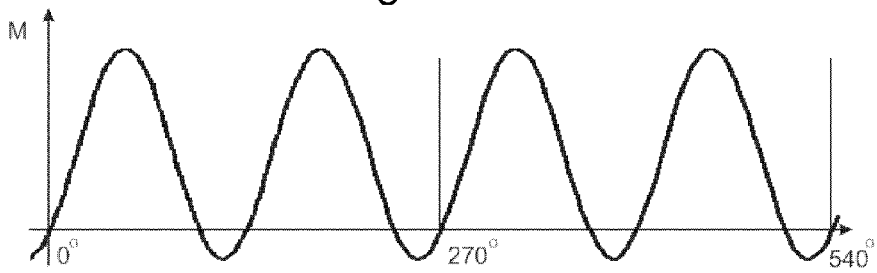
Figure 30:
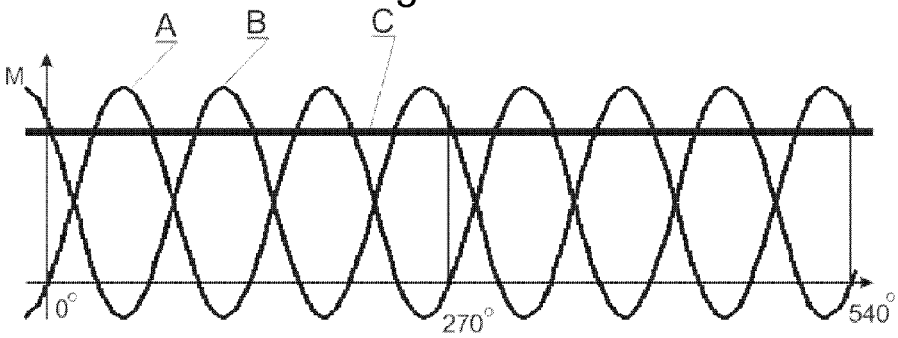
Figure 31:
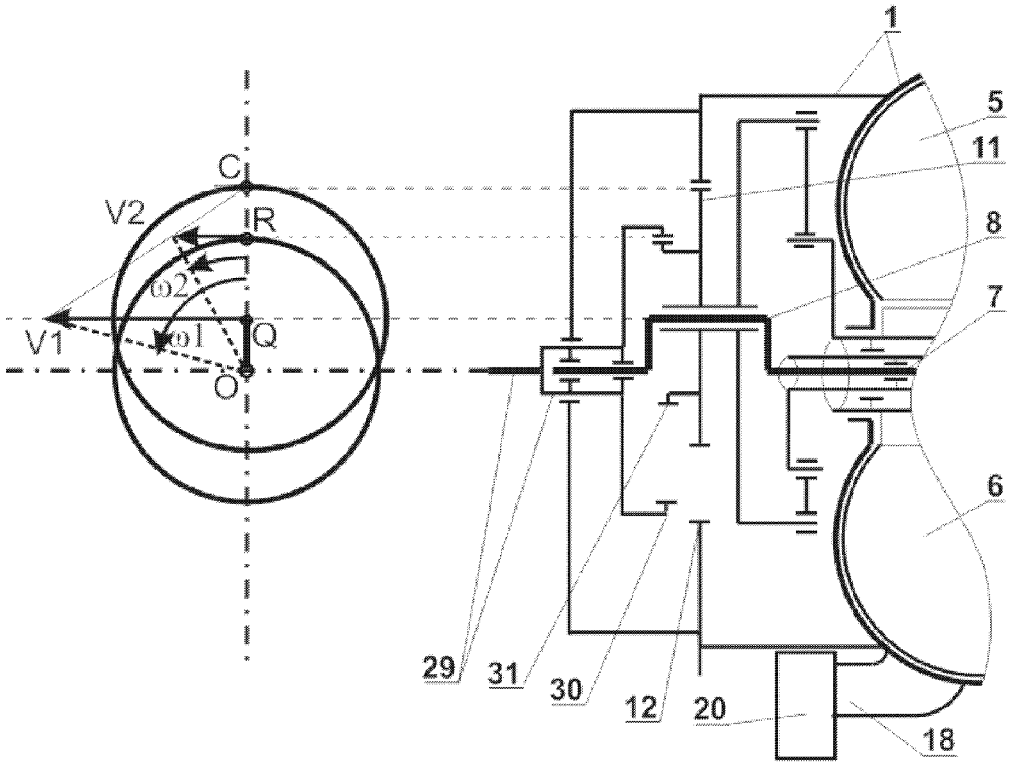
Figure 32:
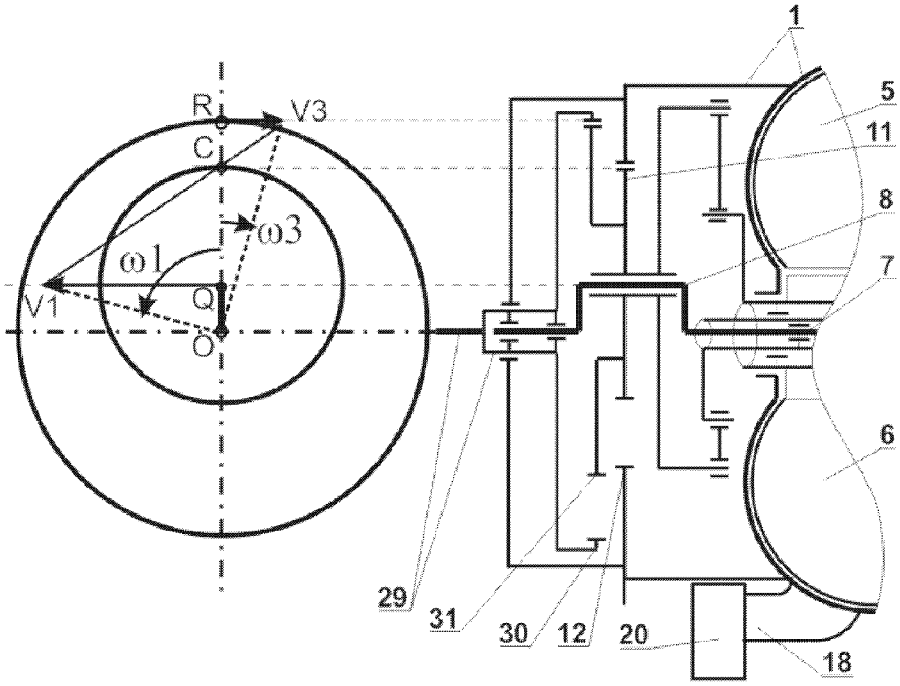
Figure 33:
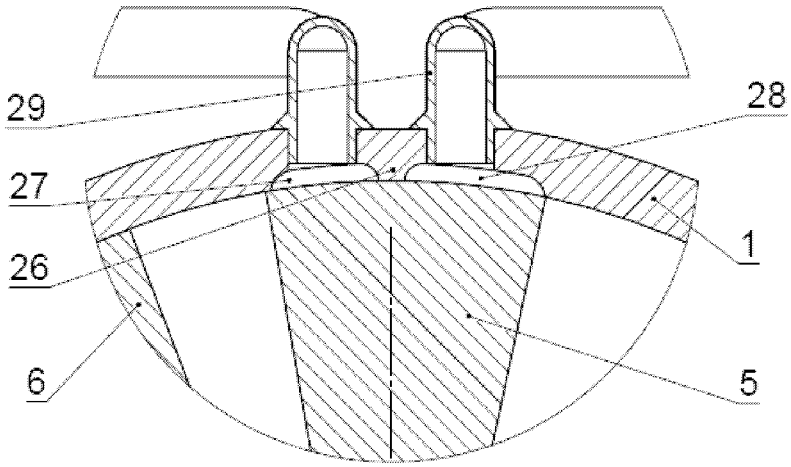
Figure 34:
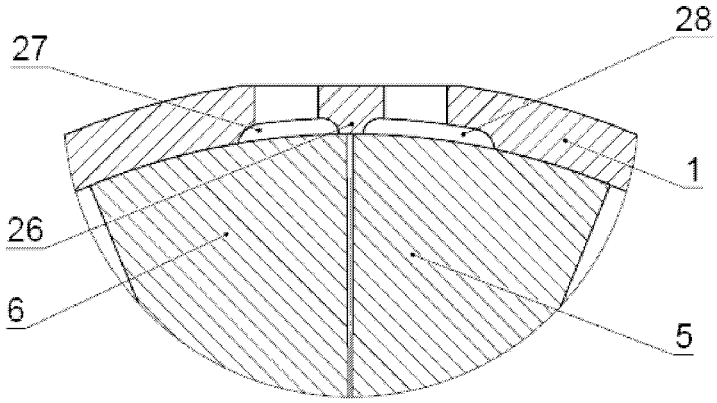
Figure 35:
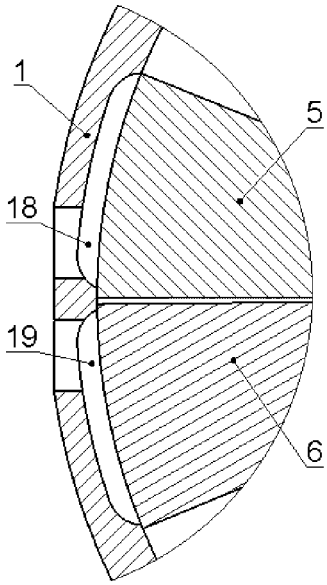
Figure 36:
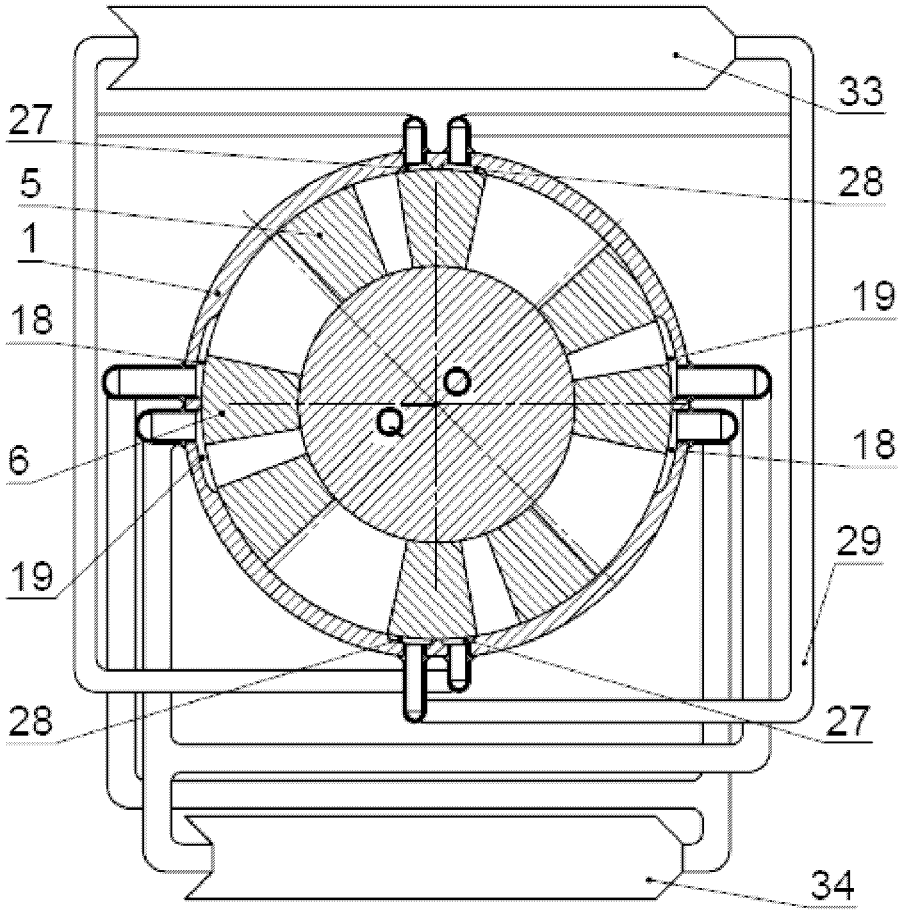
Figure 37:
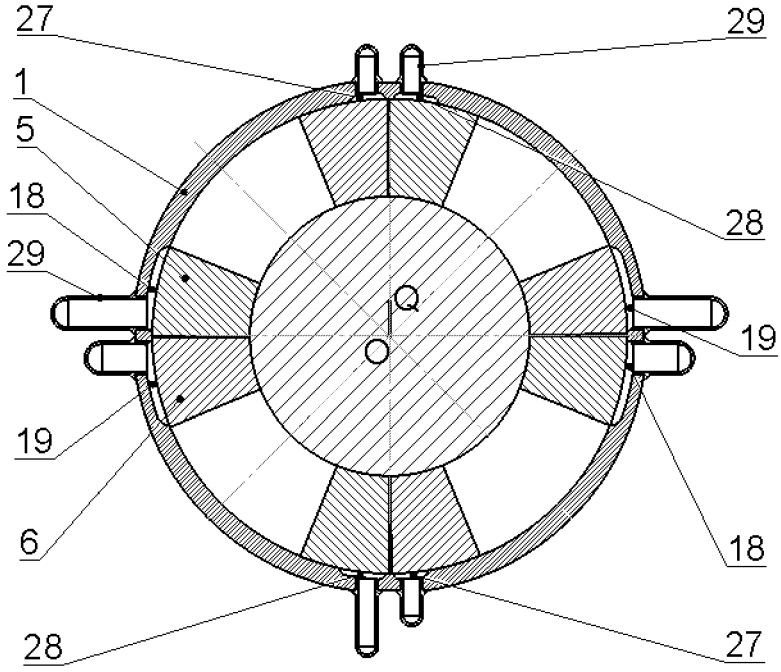
Figure 38:
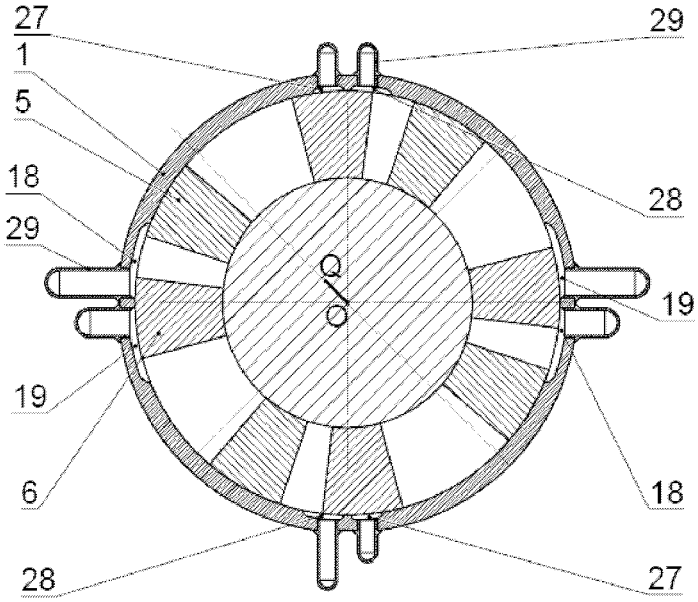
Figure 39:
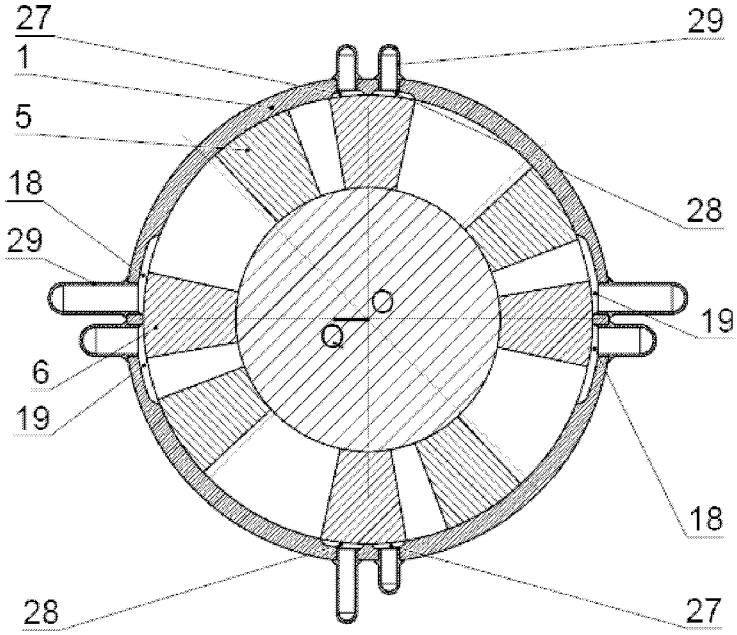
Figure 40:
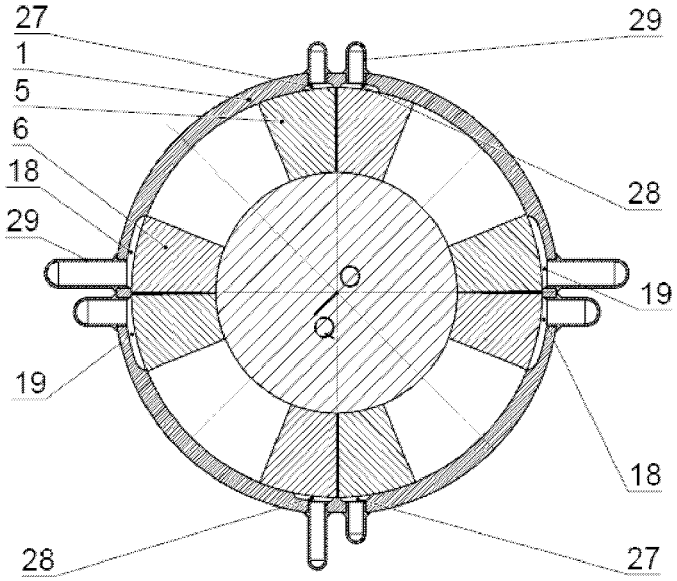
Figure 41:
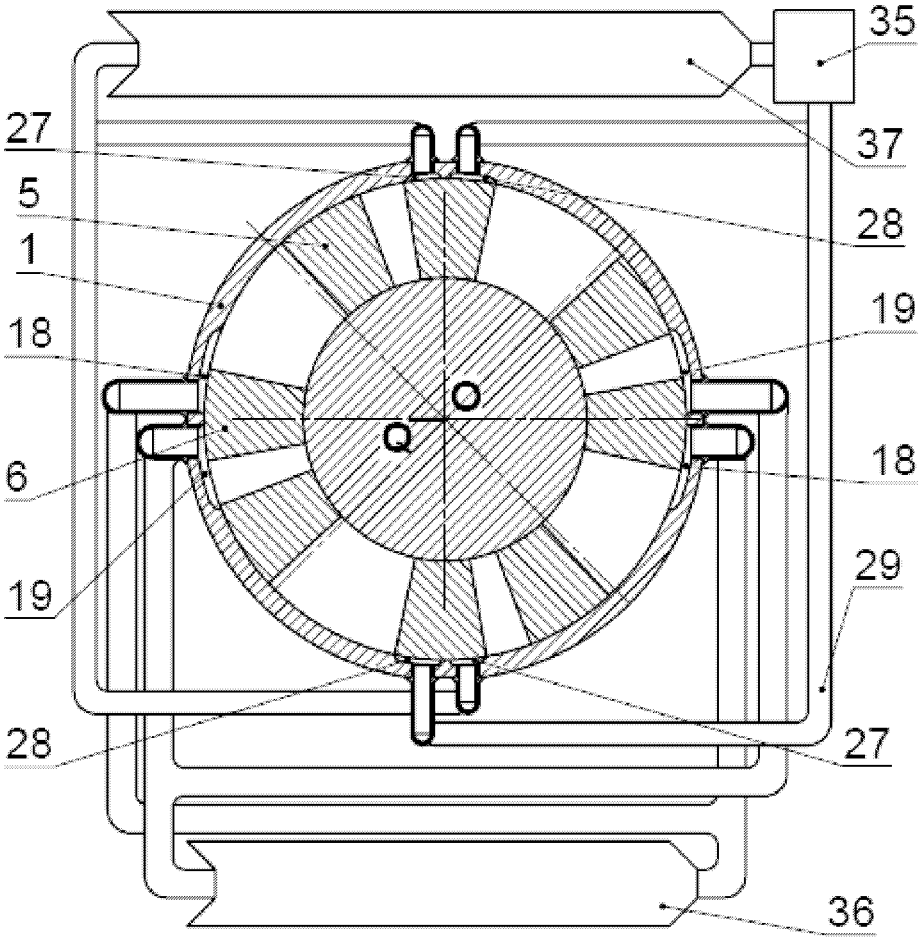
Figure 42:
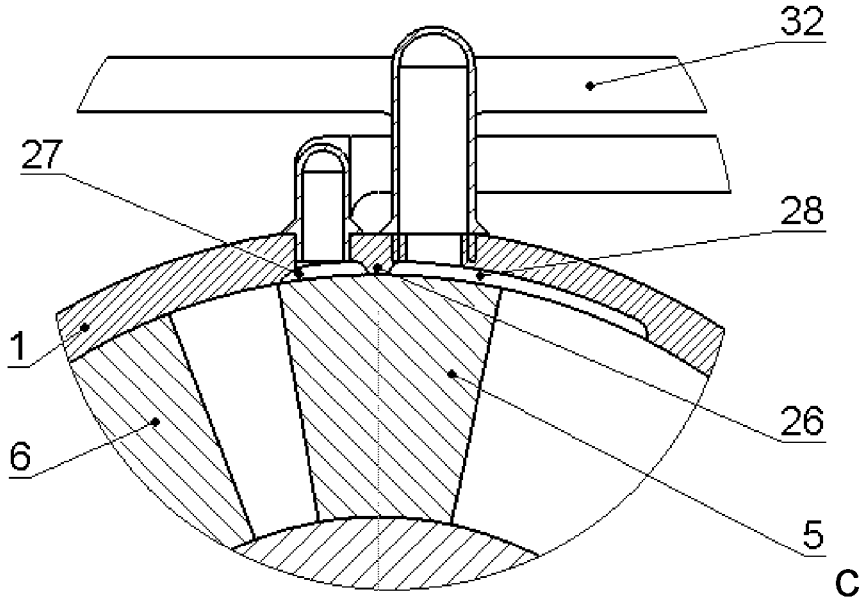
Figure 43:
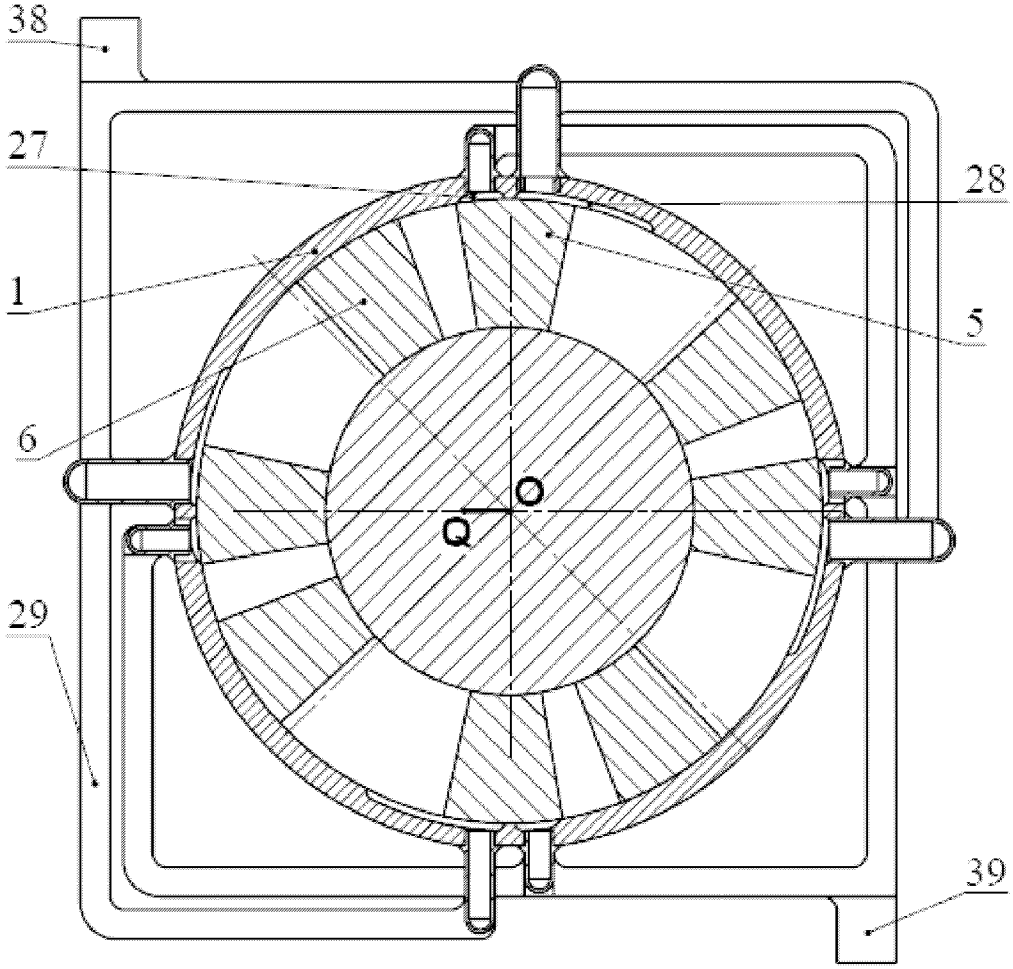
Figure 44:
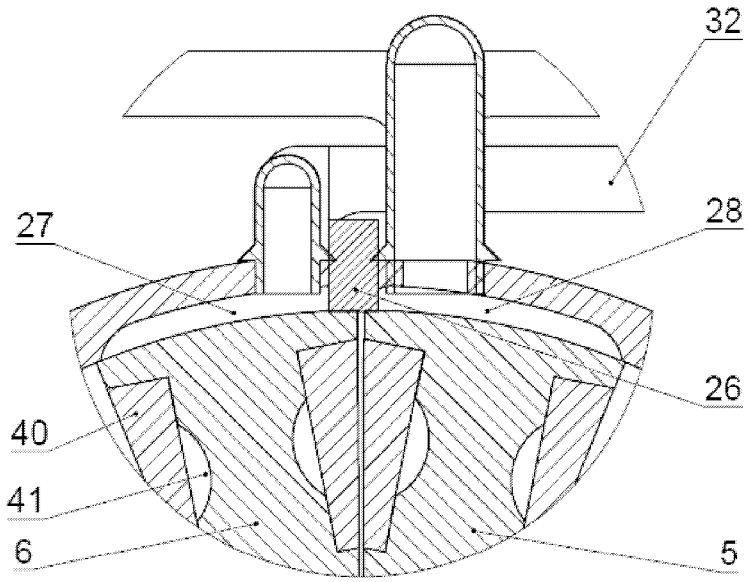
Figure 45:
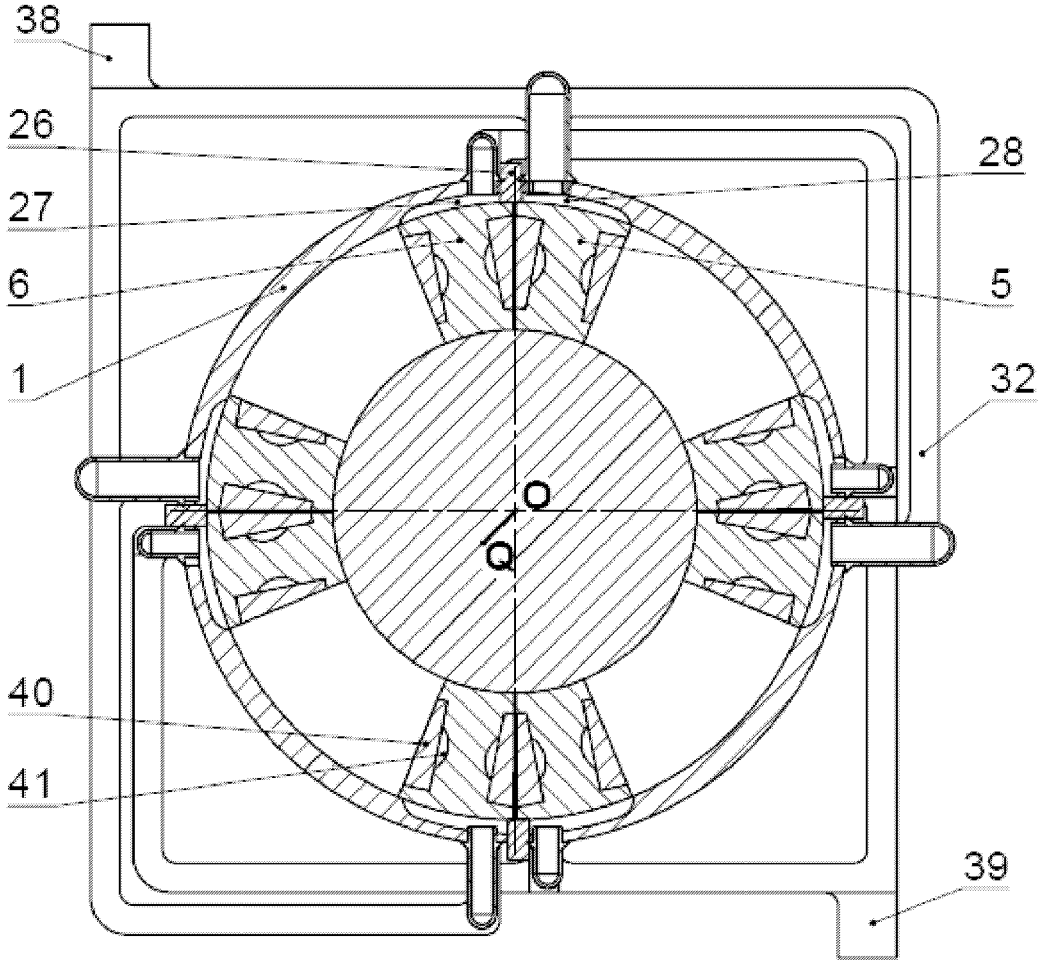

where the carrier with the planetary gear are arranged on the offset portion of the output shaft and the eccentricity of the offset portion designated by the heavy line OQ, the center of the planetary gear designated Q, while the carrier arms designated A and B;

where a pair of arms of the coaxial drive shafts are designated CO and DO;

a pair of connecting rods designated AC and BD connect the carrier AB with the arms CO and DO of the coaxial drive shafts and their corresponding positions:

in FIG. 2, an initial angular position of the pistons and of their drive mechanism where the initial "zero" (upper) angular position of the offset portion for convenience is 0° (1080°, etc.);

in FIG. 3, a view similar to FIG. 2 where the output shaft has been turned through 45° counterclockwise;

in FIG. 4, a view similar to FIG. 2 where the output shaft has been turned through 90°;

in FIG. 5, a view similar to FIG. 2 where the output shaft has been turned through 135°;

in FIG. 6, a view similar to FIG. 2 where the output shaft has been turned through 180°;

in FIG. 7, a view similar to FIG. 2 where the output shaft has been turned through 225°;

in FIG. 8, a view similar to FIG. 2 where the output shaft has been turned through 270°;

in FIG. 9, a view similar to FIG. 2 where the output shaft has been turned through 405°;

in FIG. 10, a view similar to FIG. 2 where the output shaft has been turned through 540°;

FIGS. 11-23 illustrate a cross-sectional view through the annular working chamber of the casing of the rotary internal combustion engine at various actual positions of the pistons after the output shaft has turned through 540° counterclockwise from the initial 0° (upper) angular position of the offset portion OQ, where FIG. 11 is an initial angular position of the rotary pistons in the annular working chamber at the initial "zero" (upper) angular position of the offset portion OQ (0°, 1080°, etc.);

FIG. 12 is a view similar to FIG. 11 where the offset portion OQ has been turned through 45° counterclockwise;

FIG. 13 is a view similar to FIG. 11 where the offset portion OQ has been turned through 90° counterclockwise;

FIG. 14 is a view similar to FIG. 11 where the offset portion OQ has been turned through 135° counterclockwise;

FIG. 15 is a view similar to FIG. 11 where the offset portion OQ has been turned through 180° counterclockwise;

FIG. 16 is a view similar to FIG. 11 where the offset portion OQ has been turned through 225° counterclockwise;

FIG. 17 is a view similar to FIG. 11 where the offset portion OQ has been turned through 270° counterclockwise;

FIG. 18 is a view similar to FIG. 11 where the offset portion OQ has been turned through 315° counterclockwise;

FIG. 19 is a view similar to FIG. 11 where the offset portion OQ has been turned through 260° counterclockwise;

FIG. 20 is a view similar to FIG. 11 where the offset portion OQ has been turned through 405° counterclockwise;

FIG. 21 is a view similar to FIG. 11 where the offset portion OQ has been turned through 450° counterclockwise;

FIG. 22 is a view similar to FIG. 11 where the offset portion OQ has been turned through 495° counterclockwise;

FIG. 23 is a view similar to FIG. 11 where the offset portion OQ has been turned through 540° counterclockwise;

FIG. 24 illustrates a cross-sectional view through the overflow chamber of an internal combustion engine arranged on the engine casing by means of gas-tight heat-insulation gaskets;

FIG. 25 illustrates a cross-sectional view through the overflow chamber of an internal combustion engine, the chamber having a gas-tight insert of the exit and entrance channels;

FIG. 26 illustrates a cross-sectional view through the overflow chamber of an internal combustion engine, the chamber having walls of a highly porous gas-permeable ceramic material;

FIG. 27 illustrates a longitudinal section through the planetary train of a rotary internal combustion engine operating as a positive displacement machine having a toroidal working chamber;

FIG. 28 illustrates a gear train diagram (the second embodiment) of a rotary internal combustion engine having a common output shaft with two offset portions for two planetary trains and comprising a casing arranged between the trains and consisting of two similar stages coaxial with one the other. The stages and the offset portions are designed to be settable at an angle in the range of 0° through 180° for each specific application;

FIG. 29 is a graph approximated with a sinusoid showing variations in torque M of a single-stage rotary internal combustion engine as a function of the actual angle $\phi$ of rotation of the output shaft;

FIG. 30 are graphs approximated with sinusoids showing variations in torque M (as a function of the actual angle $\phi$ of rotation of the output shaft) of each of two engine stages (curves A and B) as well as the resultant accumulation curve C of a two-stage rotary internal combustion engine;

FIG. 31 illustrates a gear train diagram of a rotary internal combustion engine having a gearbox supplied with the gearbox velocity vector diagram;

FIG. 32 illustrates a gear train diagram of a rotary internal combustion engine having a gearbox where the power take-up shaft is capable of reversal of rotation and torque (the second embodiment of the gearbox);

FIG. 33 illustrates a cross-sectional view through the overflow chamber of a rotary external combustion engine (e.g., operating on the Stirling principle) provided in the engine body as exit and entrance channels with the insert therebetween and where the channels are illustrated as stopped up with the end face of a rotary piston;

FIG. 34 illustrates a position of closed rotary pistons 5 and 6 when they stop up the exit and entrance channels and separate increasing and decreasing instant volumes;

FIG. 35 illustrates a cross-sectional view through the exit and entrance channels of an external combustion engine when the sides of adjacent rotary pistons are closed;

FIG. 36 illustrates a rotary piston machine operating on the Stirling principle and the cross-sectional view through the machine's casing;

FIGS. 37-40 illustrate a cross-sectional view through the annular working chamber of the casing of the rotary piston machine operating on the Stirling principle at various actual positions of the rotary pistons after the offset portion has turned through 135° counterclockwise from the initial 0° (upper) angular position of the offset portion OQ, where FIG. 37 is the initial angular position of the rotary pistons in the annular working chamber at the initial (upper) angular position of the offset portion OQ (0°, 1080°, etc.);

FIG. 38 is a view similar to FIG. 37 where the offset portion OQ has been turned through 45° counterclockwise;

FIG. 39 is a view similar to FIG. 37 where the offset portion OQ has been turned through 90° counterclockwise;

FIG. 40 is a view similar to FIG. 37 where the offset portion OQ has been turned through 135° counterclockwise;

FIG. 41 illustrates the way how the intake and exhaust ports communicate with the annular working chamber of the rotary-piston machine when it is used as a refrigerating machine;

FIG. 42 illustrates the exit and entrance channels of a rotary-piston machine when it is used as a compressor or for pumping various gases;

FIG. 43 illustrates the way how the intake and exhaust ports communicate with the annular working chamber of the rotary-piston machine when it is used as a blower (compressor) of air, for example;

FIG. 44 illustrates the exit and entrance channels of a rotary-piston machine when it is used as a hydraulic pump;

FIG. 45 illustrates the way how the intake and exhaust ports communicate with the annular working chamber of the rotary-piston machine when it is used as a hydraulic pump.

In FIGS. 1, 12 and 13, 15 and 16, 18 and 19, 21 and 22, 26 through 28, arrows indicate the direction of the flow of a material, e.g., gas.

BEST MODE FOR CARRYING OUT THE INVENTION

The following is a description of some embodiments of the invention, beginning with the description of the positive displacement rotary-piston machine for use as the simplest rotary internal combustion engine, where the structural parts are diagramatically shown as follows:

a casing 1 having an annular working chamber, an outer drive shaft 2, an inner drive shaft 3, arms 4 of the outer 2 and inner 3 drive shafts, axially symmetrical rotary pistons 5 and 6 fixed on coaxial drive shafts 2 and 3 respectively. The rotary pistons 5 and 6 have radial seals and end-face seals (not shown). They also can have axially symmetrical spaces on their side faces, for example, such that may function as combustion chambers in rotary internal combustion engines, an output shaft 7 shown in FIG. 1 by a heavy line, an offset portion 8 on the output shaft 7, shown as a U-bend in FIG. 1, a carrier 9 journalled on the offset portion 8 of the output shaft 7, connecting rods 10 linking the carrier 9 to the arms 4, a planetary gear 11 fixed on the carrier 9, a stationary central gear 12 meshing with the planetary gear 11 and being coaxial with the drive shafts 2 and 3, the output shaft 7, and the annular working chamber of the casing (stage) 1, a gear rim 13 fixed on the offset portion 8 of the output shaft 7, a counterbalance 14 for balancing the masses of the offset portion 8, the carrier 9, the planetary gear 11, and the connecting rods 10, a starter 15 mounted on the casing 1, an overrunning clutch 16, a gear 17 meshing the gear rim 13, an intake port 18 communicating with the working chamber of the casing (stage) 1, an exhaust port 19 also communicating with the working chamber of the casing (stage) 1, a fuel supply equipment 20 (for use in an external carburetion only), a spark plug/fuel injector 21 (the spark plug for use in an external carburetion and/or the fuel injector for use in an internal carburetion), walls 22 defining spaces for cooling the casing (stage) 1, overflow chambers 23, which can be arranged in the casing 1 (see FIGS. 11-23) as well as separately attached to the casing (stage) 1 (see FIGS. 24, 25 and 26);

gas-tight heat-insulation gaskets 24 (FIGS. 24, 25);

highly porous gas-permeable heat-resistant ceramic walls 25 (see FIG. 26) of an overflow chamber 23;

gas-tight inserts 26 (see FIG. 25);

exit 27 and entrance 28 channels of the overflow chambers 23 (see FIG. 33) are separated by inserts 26 (the channels are denominated "exit" and "entrance" to match the "exit" and "entrance" of the working fluid from/to the working chamber);

a power take-off shaft 29 used where there is a need to reduce (FIG. 31) and reverse (FIG. 32) revolutions of rotary piston internal combustion engines;

a gear wheel 30 fixed on the power take-off shaft 29;

an intermediate gear wheel 31 fixed on the planetary gear 11;

connecting pipes 32 (FIG. 36) for supplying the working fluid to a rotary piston machine, for example, one operating on the Stirling principle;

a working fluid heater 33;

a working fluid cooler 34;

a thermostatic throttle 35;

an evaporator 36;

a radiator 37;

an input manifold 38;

an output manifold 39;

a resilient adjuster 40;

resilient walls 41 defining a sealed void.

The operation of the positive displacement rotary-piston machine will now be described by the operation of the simplest rotary internal combustion engine having a planetary pair with the gear ratio $i=n/(n+1)$, where $n=1, 2, 3, 4, 5 \ldots$, i.e. a series of integers), while the number of rotary pistons mounted on each drive shaft is $n+1$. Here it is $n=3$. The number of rotary pistons is $m=3+1=4$. This engine has a gear ratio $i=3/4$ of its planetary gear pair (see FIG. 1) and comprises the stationary central gear 12 and the planetary gear 11, four rotary pistons 5 and four rotary pistons 6 mounted on the shafts 3 and 2. When the engine is being put in operation, the starter 15 is energized and, by way of the overruning clutch 16 and the gear 17, causes the heavy gear rim 13 to rotate together with the output shaft 7 rigidly connected to the rim and having the offset portion 8 as an integral part thereof. The planetary gear 11 and the carrier 9 both arranged on the offset portion 8 began motion as their axis moves and the planetary gear 11 meshes with the central gear 12. The motion is further transmitted from the carrier 9 via the connecting rods 10 to the arms 4 of the drive shafts 2 and 3 carrying the rotary pistons 5 and 6, which began rotationally oscillate in the working chamber of the casing 1.

This motion is the result of continuous variations in the angular position and an instantaneous distance to the arms of the carrier 9 (linking the connecting rods to the arms 4 of the coaxial drive shafts 2 and 3) with respect to the "zero" point of instantaneous velocities, the point being the pitch point of the gears (the stationary central gear 12 and the planetary gear 11). The arms of the carrier 9 through the connecting rods 10 move the arms 4 of the coaxial shafts 2 and 3. This is why the rotary pistons 5 and 6 mounted thereon are set in rotational and oscillatory motion in the working chamber of the casing (stage) 1. At the same time, the output shaft 7 together with the offset portion 8 and the drive shafts 2 and 3 together with the rotary pistons 5 and 6 are moving in the opposite directions. The counterweight 14 balances the masses of the offset portion 8, planetary gear 11, carrier 9 and heavy gear rim 13 serving as a balance wheel. The gear rim 13 and the counterweight 14 can be combined.

In operation of a rotary piston internal combustion engine, the gear rim 13 (see FIG. 1) serves as the engine flywheel, so it must be heavy to overcome negative component of torque as well as to smooth current output torque on the output shaft 7.

Inner chambers of the casing 1 have cooling channels defined by walls 22 and arranged for pumping a coolant therethrough. This prevents overheating the rotary piston internal combustion engine. A system of the oil cooling of the rotary pistons 5 and 6 is not shown.

Referring to FIGS. 2 through 10, there is shown an operation of the planetary gear with the planetary gear ratio i=3/4 for various output shaft 7 positions. Accordingly, the members of the kinematic gear train and the rotary pistons 5 and 6 take a strongly deterministic position. In this case, used as a coordinate grid of the rotary piston internal combustion engine kinematic train there will be used thin dot-and-dash vertical and horizontal axes in FIGS. 2-10, which extend through the axes of the working chamber of the casing 1, the shafts 2, 3, 7.

Referring to FIG. 2, there is shown an arbitrarily chosen initial 0° position of the output shaft 7 with the offset portion 8 and the corresponding position of the planetary gear 11 with the carrier 9, of the connecting rods 10 and the arms 4 of the rotary pistons 5 and 6 relative to the stationary central gear 12 and the casing (stage) 1. The with the offset portion 8 and the corresponding position of the planetary gear 11 with the carrier 9, of the connecting rods 10 and the arms 4 of the rotary pistons 5 and 6 relative to the stationary central gear 12 and the casing (stage) 1. The eccentricity of the offset portion 8 of the output shaft 7 is designated by heavy line OQ extending vertically, while the carrier 9 designated AB is positioned horizontally above the output shaft 7. The carrier 9 is linked with the drive shafts 2 and 3 by means of the connecting rods 10 shown as straight lines designated AC and BD. At the initial position, the axes, shown by dash-and-dot lines, of the pistons 5 and 6 are symmetrical with respect to the vertical axis at an acute angle thereto. The angle between the axis OC of the arm 4 of the inner drive shaft 3 and the axis of the piston 6 is designated as $\phi 1$=const. (because they are mounted on the single shaft 3), while the angle between the axis OD of the arm 4 of the outer drive shaft 2 and the axis of the piston 5 is designated as $\phi 2$=const. (because they are mounted on the single shaft 3). In FIG. 2, the angle between the axes of the arms 4 of both drive shafts 2 and 3 is minimal and designated $\Delta 1$.

Next, the output shaft 7 together with the offset portion 8 rotates anticlockwise. At the same time, by virtue of mechanical linkages, the planetary gear 11 rolls over the stationary central gear 12. The planetary gear 11 imparts motion to the carrier 9, which is rigidly connected to the planetary gear 11. This causes continuous variations in the movement of the arms QA and QB of the carrier 9 (both the direction and velocity) with respect to the "zero" point of instantaneous velocities where the point is the pitch point of the gears 11 and 12. These variations in velocities is transmitted via the connecting rods 10 from the axes of arms A and B of the carrier 9 to the axes C and D of the arms 4 of the coaxial drive shafts 2 and 3, and further to the pistons 5 and 6. In this manner the pistons are caused to rotationally oscillate in the working chamber of the casing 1.

Referring to FIG. 3, the output shaft 7 and the offset portion 8 (with the eccentricity OQ) are shown as turned through 45° counterclockwise. The planetary gear 11 with the carrier 9 are also shown as turned through 45°, but clockwise. Because the angles $\phi 1$ and $\phi 2$ are constant, the connecting rods 10 designated AC and BD are moved apart by the arms 4 designated OC and OD to form an angle $\Delta 2>\Delta 1$. The pistons 5 and 6 are also moved apart by a corresponding amount.

When the output shaft 7 has further rotated through an angle of 90° (FIG. 4) the carrier 9 takes the greater angular position, while the connecting rods 10 designated AC and BD keep on moving the arms 4 designated OC and OD apart to form an angle $\Delta 3>\Delta 2>\Delta 1$. As this takes place, the pistons 5 and 6 are found to be brought to a greater angle.

When the output shaft 7 has further rotated through an angle of 135° (FIG. 5) the carrier 9 (designated A and B), having been turned clockwise, takes the position at 45° to the vertical, while the connecting rods 10 designated AC and BD continue to move the arms 4 designated OC and OD together to form an angle $\Delta 4<\Delta 3$. However, because the angles $\phi 1$ and $\phi 2$ are constant, the pistons 5 and 6 move apart to a maximum position, i.e. at an angle $\Delta 4>\Delta 3>\Delta 2>\Delta 1$.

When the output shaft 7 has further rotated through an angle of 180° (FIG. 6), the connecting rods 10 designated AC and BD keep on moving the arms 4 designated OC and OD together to form an angle $\Delta 5<\Delta 4$. As this takes place, the pistons 5 and 6 are found to be brought together. The carrier 9 designated AB is turned clockwise to a still greater angle.

When the output shaft 7 has further rotated through an angle of 225° (FIG. 7) the connecting rods 10 designated AC and BD keep on moving the arms 4 designated OC and OD together to form an angle $\Delta 6<\Delta 5$. As this takes place, the pistons 5 and 6 are found to be brought together vertically, while the carrier 9 designated AB is turned clockwise to a greater angle.

When the output shaft 7 has further rotated through an angle of 270° (FIG. 8) the connecting rods 10 designated AC and BD keep on moving the arms 4 designated OC and OD together to form an angle $\Delta 7<\Delta 6$. As this takes place, the pistons 5 and 6 are found to be brought together vertically, while the carrier 9 designated AB takes a vertical position.

When the output shaft 7 and the offset portion 8 (with the eccentricity OQ) has further rotated through an angle of 405°, the members of the kinematic train (the carrier 9, the connecting rods 10, the arms 4) sequentially take intermediate positions and bring the pistons 5 and 6 apart to the maximum angular position as shown in FIG. 9. As this takes place, the carrier 9 takes a 45° position to the vertical.

As the output shaft 7 and the offset portion 8 (with the eccentricity OQ) continue rotation through an angle of 540°, the members of the kinematic train (the carrier 9, the connecting rods 10, the arms 4) sequentially take intermediate positions and bring the pistons 5 and 6 together to the minimum angular position as shown in FIG. 10. As this takes place, the pistons 5 and 6, the arms 4, and the carrier 9 are found in a position similar to the initial 0° angular position of the output shaft 7 (FIG. 2). Consequently, as the output shaft 7 and the offset portion 8 (with the eccentricity OQ) rotation through an angle of 1080°, the members of the kinematic train and the rotary pistons 5 and 6 will take the initial position as shown in FIG. 2.

Beginning from the initial 0° position, rotation of the output shaft 7 and the offset portion 8 through each 135° causes the planetary train to move the rotary pistons 5 and 6 together and apart relative to the horizontal and vertical center lines (see at 0° in FIG. 2, at 135° in FIG. 5, at 270° in FIG. 8, at 405° in FIG. 9, and at 540° in FIG. 10). Consequently, such planetary train of the machine of the invention ensures the rotational and oscillatory movement of the rotary pistons 5 and 6. This provides consistency in the start of scanning line of the rotary pistons 5 and 6 relative to the casing 1, the stationary central gear 12, the intake port 18 and the exhaust port 19, exit 18 and entrance 19 channels, and the overflow chamber 23.

FIGS. 11-23 illustrate a cross-sectional view through the annular working chamber of the casing 1 of the simplest rotary internal combustion engine at various actual positions of the pistons 5 and 6 after the output shaft 7 has turned through 540°. This engine has intake ports 18 and exhaust ports 19 separated by a partition (not referenced), as well as the planetary train, the operation of which was discussed hereinabove in detail (FIGS. 2 through 10), the positions of the pistons 5 and 6 in FIGS. 2-10 being analogous with those in FIGS. 11-7, 20 and 23. In the annular working chamber of the engine, there may occur eight variable subchambers providing space enclosed by the faces of the pistons 5 and 6 and by the casing 1. These eight instant working subchambers are designated in FIGS. 11-23 by encircled numerals from "1" to "8".

In FIG. 11 (the initial position is 0° rotation of the output shaft 7), among the instant working subchambers "1" being the minimal volume enclosed between the intake port 18 and the exhaust port 19;

"2" being the largest volume corresponding to the completion of the intake stroke and the beginning of the compression stroke as in a rotary internal combustion engine;

"3" being the minimal volume enclosed opposite the "upper" overflow chamber 23;

"4" being the largest volume corresponding to the completion of the combustion stroke and the beginning of the exhaust stroke as in a rotary internal combustion engine;

"5" being the minimal volume enclosed between the intake port 18 and the exhaust port 19;

"6" being the largest volume corresponding to the completion of the intake stroke and the beginning of the compression stroke as in a rotary internal combustion engine;

"7" being the minimal volume enclosed opposite the "lower" overflow chamber 23;

"8" being of the maximal volume, corresponding to the completion of the combustion stroke and the beginning of the exhaust stroke as in a rotary internal combustion engine;

In FIG. 12 (45° rotation of the output shaft 7), among the instant working subchambers "1" being connected through the intake port 18 with the fuel supply equipment 20 (for use with an external carburetion only) and having an increasing volume corresponding to the beginning of the intake stroke as in a rotary internal combustion engine;

"2" being a closed subchamber of a decreasing volume corresponding to the running of the compression stroke as in a rotary internal combustion engine;

"3" being connected to the "upper" overflow chamber 23 and having an increasing volume corresponding to the beginning of the combustion stroke as in a rotary internal combustion engine;

"4" communicating with the exhaust port 19 and, being of a decreasing volume, corresponding to the running of the exhaust stroke as in a rotary internal combustion engine;

"5" being connected through the intake port 18 with the fuel supply equipment 20 (for use with an external carburetion only) and having an increasing volume corresponding to the beginning of the intake stroke as in a rotary internal combustion engine;

"6" being a closed subchamber of a decreasing volume corresponding to the running of the compression stroke as in a rotary internal combustion engine;

"7" communicating with the "lower" overflow chamber 23 and being of an increasing volume corresponding to the beginning of the combustion stroke as in a rotary internal combustion engine;

"8" communicating with the exhaust port 19 and being of a decreasing volume corresponding to the beginning of the exhaust stroke as in a rotary internal combustion engine;

In FIG. 13 (90° rotation of the output shaft 7), among the instant working subchambers "1" being connected through the intake port 18 with the fuel supply equipment 20 and having an increasing volume corresponding to the running of the intake stroke as in a rotary internal combustion engine;

"2" being a closed subchamber of a decreasing volume corresponding to the running of the compression stroke as in a rotary internal combustion engine;

"3" being a closed subchamber of an increasing volume corresponding to the running of the combustion stroke as in a rotary internal combustion engine;

"4" communicating with the exhaust port 19 and being of a decreasing volume corresponding to the running of the exhaust stroke as in a rotary internal combustion engine;

"5" being connected through the intake port 18 with the fuel supply equipment 20 and having an increasing volume corresponding to the running of the intake stroke as in a rotary internal combustion engine;

"6" being a closed subchamber of a decreasing volume corresponding to the running of the compression stroke as in a rotary internal combustion engine;

"7" being a closed subchamber of an increasing volume corresponding to the running of the combustion stroke as in a rotary internal combustion engine;

"8" communicating with the exhaust port 19 and being of a decreasing volume corresponding to the running of the exhaust stroke as in a rotary internal combustion engine;

FIG. 14 (135° rotation of the output shaft 7) illustrates instant working subchambers that follow. It should be noted that the positions of the instant working subchambers 2 and 1, 3 and 2, 4 and 3, 5 and 4, 6 and 5, 7 and 6, 8 and 7 in FIGS. 11 and 14 are similar, so similar is the running of the strokes of a rotary internal combustion engine. In other words, the instant working subchambers in a rotary internal combustion engine sequentially reproduce the operation of an internal combustion engine. The sides of the adjacent rotary pistons 5 and 6 take intermediate positions and close onto each other to form a minimal space between them at the same positions in the casing 1 as the output shaft 7 rotates through 135° (FIGS. 11, 14, 17, 20, 23). The phase position of the rotary pistons 5 and 6 as well as their sides with respect to the intake ports 18, exhaust ports 19, overflow chambers 23 and their exit channels 27 and entrance channels 28 is uniquely determined by the position of the output shaft 7 and the offset portion 8.

Where the output shaft 7 rotates through 540° (FIG. 23), the rotary pistons 5 and 6 will take an axisymmetric position relative to the initial 0° angle (FIG. 11). Consequently, the running cycle of a rotary internal combustion engine involving all four instant subchambers will be sequentially reproduced at the same time in the "upper" and "lower" portions of the working chamber of the casing 1. As the output shaft 7 rotates between 540° and 1080°, the running cycle of a rotary internal combustion engine involving all four instant subchambers will again be sequentially reproduced and the rotary pistons 5 and 6 will take their initial position (FIG. 11). Therefore, the running cycle of a rotary internal combustion engine involving all eight instant subchambers will again be sequentially reproduced each time as the output shaft 7 rotates through 540°.

A rotary internal combustion engine operates as follows. Fuel is supplied by the fuel supply equipment 20 into the intake port 18 (where there is an external carburetion). Then the fuel is mixed with air and enters increasing instant subchambers (FIGS. 12, 13, 15, 16, 18, 19, 21, 22). This is an intake stroke. Next, the air-fuel mixture is compressed in closed decreasing instant subchambers (FIGS. 11-23). This is a compression stroke. Then the decreasing instant subchambers start to inject the air-fuel mixture into the overflow chambers 23 (FIGS. 24 and 26) under an excess pressure. First, the air-fuel mixture is injected via the divergent exit channel 27 (it is called "exit" because the working fluid "exits" from the working chamber), which is defined by the edges of the overflow chamber 23 and the rotary piston 5 or 6. The cross-section of the exit channel 27 is further decreased to become the smallest when the sides of the rotary pistons are closed. The injection of the air-fuel mixture is initiated due to a design feature providing an excess pressure to simultaneously feed the air-fuel mixture into the overflow chambers 23 at the rated speed of the rotary internal combustion engine. In this case, the time between the beginning of feeding the air-fuel mixture into the overflow chambers 23 and the closing of the sides of the rotary pistons 5 and 6 is also decreased in comparison with the time between the combustion delay and combustion heat release. This ensures unidirectionality of the working fluid flow through the overflow chambers 23 for this is required for such rotary internal combustion engine to operate. The experience suggests that combustion delay and combustion heat release with the spark ignition is equal to 20° to 30° rotation of the crankshaft at the rated speed of a piston engine.

In such an engine (with an external carburetion), there is a sufficiently prolonged and qualitative mixing of fuel with air between the sides of rotary pistons during the compression stroke. The afterinjection of the air-fuel mixture into the overflow chamber results in further turbulance of the mixture. At the rated speed of a rotary internal combustion engine, the time of injection is shorter than the combustion delay. The fuel, therefore, is evaporated, reliably ignited, quickly and completely burned with an excess of air and under a maximum possible pressure as soon as it gets into the closed overflow chamber heated to a high-temperature. This provides for the normal operation of such rotary internal combustion engine on lean air-fuel mixtures with both external and internal carburetion. Consequently, with an external carburetion (in contrast to an internal carburetion), the power of a rotary internal combustion engine may be adjusted by varying the composition of the air-fuel mixture. Also, owing to an excess pressure and a high temperature of the working fluid in the overflow chambers the air-fuel mixture ignites regardless of the fuel grade used with both external and internal carburetion.

Initial ignition of the air-fuel mixture (with an external carburetion) is done by a spark plug 21 or heater plug. The plug may be then switched off as further operation of the rotary internal combustion engine provides for fuel ignition at elevated temperatures of the working fluid in the overflow chambers 23 and of the walls thereof. With an internal carburetion, the fuel is fed into the overflow chambers 23 by means of a fuel injector 21. The most intensive combustion heat release in the overflow chambers 23 is with the sides of the rotary pistons 5 and 6 closed. It is at this time that the overflow chambers 23 are isolated because the exit channels 27 and the entrance channels 28 are closed with the end faces of the rotary pistons 5 and 6. It is to be noted that the relative velocities of the sides of the rotary pistons 5 and 6 are minimal as they are closing. This provides a time interval for the attainment of an elevated temperature resulting from the combustion heat release and the maximum pressure increase in the overflow chambers 23 when they are closed.

The fuel combustion may be terminated in the increasing instant subchambers at the beginning of the combustion stroke after the entrance channels 28 of the overflow chambers 23 are opened by means of the rotary pistons 5 and 6 (FIGS. 12, 15, 18, 21). The combustion stroke then runs on but in closed increasing instant subchambers (FIGS. 13, 14, 16, 17, 19, 20, 22).

When the increasing instant subchambers are let to communicate with the exhaust ports 19 there begins the exhaust stroke (FIGS. 12, 13, 15, 16, 18, 19, 21, 22) and it runs on until the sides of the rotary pistons 5 and 6 are closed. When the sides of the rotary pistons 5 and 6 are closed, the instant subchambers are the smallest. This enables a practically complete exhaust of burnt gases from the working chamber of the casing 1. Such sequence of the strokes and specific phases (i.e., the exit and entering of the working fluid from and to the working chamber through the exit channels 27 and entrance channels 28 of the overflow chambers 23) enables the rotary internal combustion engine having overflow chambers to operate normally.

FIG. 24 illustrates the overflow chamber 23 mounted on the casing 1 through a gas-tight heat-insulation gasket 24. This implementation of the overflow chamber 23 has a twofold effect, namely, the heat-insulation of the casing 1 from hot overflow chambers 23 and maintaining the chambers at an all-time elevated temperature. The elevated temperature is required to reliably ignite fuel regardless of its grade and to bring the fuel combustion process to adiabatic.

FIG. 25 illustrates the overflow chamber 23 equipped with a gas-tight insert 26 and the rotary pistons 5 and 6 at the start of closing (i.e., the sides being minimally spaced apart though both sides are still on the left from the vertical axis of the kinematic mechanism). The gas-tight insert 26 ensures instantaneous insulation of the sides of the rotary pistons 5 and 6 from the high pressure and temperature working fluid in the overflow chambers 23 during closing (FIGS. 11, 14, 17, 20, 23). The relative velocities of the sides of the rotary pistons 5 and 6 are minimal as they are closing. Therefore, the time of the insulation of the sides of the rotary pistons 5 and 6 from the pick pressure and temperature of the working fluid is critical relieving thermal and mechanical loads. Thus reliability of operation of a rotary internal combustion engine is enhanced.

The provision of the overflow chamber 23 with the gas-tight insert 26 results in structurally explicit functional channels between the chamber walls and the edges of the gas-tight insert 26. These are the exit channel 27 and the entrance channel 28.

FIG. 26 illustrates the overflow chamber 23 having walls 25 made from a highly porous gas-permeable and heat-resistant ceramic material such as silicon carbide. Such ceramic walls 25 of good gas-permeability and significant heat capacity maintain an all-time high temperature while the rotary internal combustion engine runs. Reliability and completeness of combustion under maximum compression when the air-fuel mixture enters the overflow chambers 23 [4] is ensured. Use of porous ceramics in a rotary internal combustion engine enables the same to run on various fuel grades with good efficiency and environmental safety.

FIG. 27 illustrates the simplest rotary internal combustion engine comprising the casing 1 with a toroidal working chamber. This engine operates in the same way as that described above with references to FIGS. 1 and 11-23 and having the annular working chamber. But the toroidal working chamber makes it possible to do away with angular joints between sealing components and to use compression rings to thereby minimize leaks of compressed gases and simplify the sealing system of the rotary pistons 5 and 6.

In FIG. 28, the rotary internal combustion engine comprises the output shaft 7 having two offset portions 8. The casing 1 consists of two stages arranged between two planetary trains, such as described above with reference to FIGS. 2-10. The stages of the casing 1 as well the offset portions 8 on the common output shaft 7 must be set at an angle relative to each other so that the torques produced at both stages should be combined on the output shaft 7. The amount of the setting may amount to 180° and depends on the various applications of the engine. The angles of setting the stages of the casing 1 and the offset portions 8 are usually chosen such as to ensure phase shifting of the maximal and minimal amplitudes of the torques produced at each stage to produce the most "smoothed" total torque.

FIG. 29 represents a graph approximated with a sinusoid showing variations in torque $M=f(\phi)$, where $\phi$ is an angle of rotation of the output shaft 7 of the simplest rotary internal combustion engine (FIGS. 1, 11-23, 28) having a single-stage casing 1. In this case, the torque has not only a high torque-variation amplitude, but a negative component as well. In order to overcome the negative component, the gear rim 12 must be heavy to serve as a balance wheel, though the engine gets heavier.

The rotary internal combustion engine with the two-stage casing 1 (FIG. 28) produces a smooth resultant torque because the torques of both stages are combined on the common output shaft 7. In FIG. 30, curve "A" is a graph approximated with a sinusoid showing variations in the torque of the left-hand stage, curve "B" is that of the right-hand stage, and curve "C" is a graph showing the total torque on both stages without a negative component. Consequently, the rotary internal combustion engine with the two-stage casing 1 and under load will be exposed to a lower level of vibrations. This will have a beneficial effect on the reliability and service life of both the engine and the load. In this case the gear rim 13 can be as light-weight as possible on conditions that they sufficiently strong to thus reduce the weight of the rotary internal combustion engine.

The planetary train of the rotary internal combustion engine makes it possible to reduce revolutions and torque of the engine very simply. FIG. 31 illustrates the kinematic train of a rotary internal combustion engine with a reducing function and an instantaneous velocity vector diagram of the reducing links. In this case the torque of the rotary internal combustion engine is measured at a reducing shaft 29 carrying a reducing gear wheel 30. The gear wheel is meshed with an intermediate gear wheel 31 mounted on a planetary gear 11. In FIG. 31, the letters OQ designate the eccentricity of the offset portion 8, which passes through the axis of the planetary gear 11. The instantaneous velocity of the offset portion 8 is designated by vector QV1. Accordingly, the angular velocity of the output shaft 7 is defined by the angle between a vertical line and the segment OV1 and the angle is designated $\omega 1$. The pitch point of the stationary central gear 12 and the planetary gear 11 has "zero" velocity. The point is found on the vertical axis OQ and is designated C in FIG. 31. Consequently, the straight line CV1 is representative of instantaneous velocities of material points on a plane to which the axis OQ is normal. The pitch point of the intermediate gear 31 and the reducing gear wheel 30 is also involved. The point is at the base of the instantaneous linear velocity vector designated RV2. The reducing gear wheel 30 is mounted on a reducing shaft 29, therefore its angular velocity is defined by the angle between a vertical line and the segment OV2 and the angle is designated $\omega 2$. In this instance $\omega 2<\omega 1$. This means that revolutions of the reducing shaft 29 are lower and the torque thereof correspondingly higher as compared with those of the output shaft 7. In the general case, the reduction of revolutions of the output shaft 7 and the direction of rotation of the reducing shaft 29 are a function of the eccentricity of the offset portion 8, the relation between the diameters of the stationary central gear 12 and the planetary gear 11, the relation between the diameters of the intermediate gear 31 and the reducing gear wheel 30.

The possibility of changing the direction of rotation of the reducing shaft 29 in a rotary internal combustion engine without additional kinematic links is illustrated in FIG. 32. In this instance, the fact that the diameter of the reducing gear wheel 30 is larger than that of the stationary central gear 12 is critical to the changing of the direction of rotation of the reducing shaft 29. This is the reason for the vector RV3 to look in the opposite direction compared with the vector QV1 with respect to the "zero" point of instantaneous velocities on the vertical axis in the velocity vector diagram. The reducing shaft 29 will correspondingly rotate in the opposite direction.

To illustrate the reverse reducing action, the above-described basic data were used in the construction of another instantaneous velocity vector diagram. The value and direction of the vector QV1 for the velocity of the center of rotation of the planetary gear 11 about the offset portion 8 of the output shaft 7 are the same. A straight line is drawn from the point V1 at the end of the vector QV1 through the point C of the center of instantaneous velocities on the vertical axis OQ to the point of intersection with the line of projected meshing of the gear wheels 30 and 31. Thus a graphic representation of the vector RV3 for the linear velocity of this meshing is made. The angle between the vertical axis and the dotted line OV3, being designated $\omega 3$, graphically represents the direction and magnitude of the angular velocity of rotation of the reducing gear wheel 30 and the reducing shaft 29. As can be seen in FIG. 32, the magnitudes $\omega 1$ and $\omega 3$ are opposed to mean that the shafts 7 and 29 rotate in the opposite directions. In this case, $|\omega 3|<|\omega 1|$ to mean that that revolutions of the reducing shaft 29 are lower and the torque thereof correspondingly higher as compared with those of the output shaft 7.

Heat engines operating on a closed thermodynamic cycle, for example, external combustion engines implementing the Stirling principle [5], refrigerating machines or heat pumps, may be constructed as positive displacement rotary-piston machines as disclosed hereinafter. In these heat engines, dissimilar in application, the cycles of compression and expansion of the working fluid are carried out at various temperatures. The flow of the working fluid is adjusted by varying its volume. This principle forms the basis of converting heat to work or work to heat [6]. In order that such heat machines operate efficiently, it is expedient to minimize cumulative volumes including the exit channels 27 and the entrance channels 28 as well as the intake ports 18 and the exhaust ports 19 as illustrated in FIGS. 33 and 34.

Referring to FIG. 33, there are shown the exit channels 27 and the entrance channels 28 provided directly in the casing 1 of a rotary-piston machine and separated by the insert 26. Here the insert 26 is integral with the casing 1. FIG. 33 illustrates a position when both channels 27 and 28 are blocked with the end face of one of the rotary pistons 5 and 6. In this position, the decreasing instant subchamber (on the side of the intake port 18) and the increasing instant subchamber (on the side of the exhaust port 19) adjacent to the sides of the rotary pistons 5 and 6 are separated.

FIG. 34 shows an operative position when both channels 27 and 28 are blocked with the end faces of both rotary pistons 5 and 6 closed. The increasing and decreasing instant subchambers adjacent to the sides of the rotary pistons are also separated. In contrast to an internal combustion engine the channels 27 and 28 are connected and the working fluid correspondingly flows over in the heat machines operating on a closed thermodynamic cycle (the Stirling type) well outside the overflow chamber 23.

FIG. 35 shows relatively small intake and exhaust ports 18 and 19 both provided directly in the casing 1 of a rotary-piston machine and separated by a partition (not specifically designated) of the casing 1.

FIG. 35 shows a positive displacement rotary-piston machine implementing the Stirling principle [6]. The machine comprises a planetary train with the gear ratio i=3/4 of a gear pair including the gears 11 and 12. The operation of such train has been described in detail above (FIGS. 2-10). Connecting pipes 32 deliver the working fluid among the rotary-piston machine, heater 33, and cooler 34 in a closed loop. The position of the rotary pistons 5 and 6 in FIG. 35 corresponds to 90° rotation of the output shaft 7. The working chamber of the casing 1 of such engine is similar to that of a rotary-piston internal combustion engine (FIGS. 11-23) and has pairs of axially symmetric intake ports 18 and exhaust ports 19, and the exit channels 27 and the entrance channels 28 as well. The ports and channels are connected as follows:

the intake ports 18 are connected to the output side of the cooler 34, the output side being symbolized as a convexity;

the exhaust ports 19 are connected to the input side of the cooler 34, the input side being symbolized as a concavity;

the exit channels 27 are connected to the input side of the heater 33, the input side being symbolized as a concavity;

the entrance channels 28 are connected to the output side of the heater 33, the output side being symbolized as a convexity.

FIGS. 37-40 illustrate a cross-sectional view through the annular working chamber of the casing 1 of the simplest Stirling engine at 4 positions (0°, 45°, 90°, 135°) after the output shaft 7 has turned through a certain angle. The corresponding positions of the rotary pistons 5 and 6 with respect to the ports 18, 19 and the channels 27, 28 are also shown. The engine has 8 instant subchambers just as the rotary-piston internal combustion engine (FIGS. 11-23), wherein the operating cycles are similar to those of the rotary-piston internal combustion engine. To insure the normal operation of such external combustion engine, it is important to effectively cool the working fluid in the cooler 34 following its useful work while being expanded. When the working fluid goes through the heater 33, it is also important to effectively heat the working fluid to a temperature enabling its useful work while being expanded.

A refrigerating machine (FIG. 41) is like an external combustion engine (FIG. 36). The refrigerating machine is distinguished only by a thermostatic throttle 35. In such rotary-piston machine, mechanical work of rotation of the output shaft 7 is inversely transformed into a temperature difference of the evaporator 36 (it is under a low temperature and absorbs heat) and the radiator 37 (it is under a high temperature and exchanges heat). A refrigerating machine generally runs at constant revolutions of the output shaft 7. The operation of such refrigerating machine is controlled by adjusting the throttle 35. The power consumed by the rotary-piston machine is thus varied as well as the temperature difference of the evaporator 36 and the radiator 37 together with corresponding absorption and exchange of heat.

A rotary-piston machine designed for compressing (compressor) or for pumping various gases is structurally similar to those hereinbefore described (the rotary-piston internal combustion engine shown in FIGS. 1-23, the Stirling-type engine shown in FIGS. 33-40, the refrigerating machine shown in FIG. 41). FIG. 42 illustrates the exit channel 27 and the entrance channel 28 of a rotary-piston machine comprising a planetary train with the gear ratio i=3/4. The entrance channel 28 features a substantially expanded stage. This makes it possible to have 4 pairs of the exit channels 27 and the entrance channels 28 (FIG. 43). These channels are connected via connecting pipes 32 to the input manifold 38 and output manifold 39 respectively. Such rotary-piston machine may also be used as a vacuum engine to withdraw various gases.

The rotary-piston machines may be used as hydrotransmission devices to pump liquids, e.g., in processing lines for a measured filling of containers. This is possible because the number of revolutions of the output shaft 7 is matched one-to-one with the amount pumped liquid (on conditions that the entire working space of the rotary-piston machine is filled with the liquid). The rotary-piston machine for displacement pumping liquids (FIG. 45) comprising a planetary train with the gear ratio i=3/4 (for 8 instant subchambers), just as the compressor (FIG. 43), has 4 pairs of the exit channels 27 and the entrance channels 28. These channels are connected via connecting pipes 32 to the input manifold 38 and output manifold 39 respectively. FIG. 44 illustrates the exit channels 27 and the entrance channels 28 of the hydrotransmission rotary-piston machine. The exit channels 27 and the entrance channels 28 are arranged on both sides of the inserts 26. The exit channels 27 and the entrance channels 28 extend circumferentially so (FIG. 44) that the end faces of the rotary pistons 5 and 6 when their sides are closed (the angles of rotation of the output shaft 7 are multiple of 135°) and the inserts 26 isolate them one from the other.

As opposed to compressible gas, liquids are practically non-compressible. Proper allowance must be made for this fact so as to avoid hydraulic shock while operating displacement hydrotransmission machines. The sides of the rotary pistons 5 and 6 of hydrotransmission machines must be provided with an adjuster 40 made from an elasto-volumetric material, for example, expanded waterproof rubber. To avoid hydraulic shock, the sides of the rotary pistons 5 and 6 may be provided with hermetic voids defined by resilient walls 41. This insures the normal operation of such hydrotransmission rotary-piston machine.

Industrial Applicability

The positive displacement rotary-piston machine according to the invention has no design constraints as regards specific materials, coatings, tools, and equipment as well as methods of their application, which are not known in the art of general engineering. various forms of its structure are simple to produce in modern engineering plants. It can be manufactured from any suitable engineering materials with the use of existing machinery and conventional production processes. Therefore, the positive displacement rotary-piston machine is suitable for serial production and can be used on an industrial scale.

LITERATURE

1. Архангельский В. М. и др. Автомобильные двигатели. -М.; Машиностроение, -496 с., стр. 106-107. (Arkhangelsky, V. M. et al. Automobile engines—Moscow, Mashinostroyenie Publishers, pages 106-107. In Russian)

2. Ленин и др М. Автомобильные, и тракторные двигатели Теория (системы питания конструкции и и расчёт) Высш.школа; -М.; 1969, стр. 120. (Lenin, I. M. et al. Automobile and tractor engines (Theory, feed circuits, designs and computation) Vyshaya shkola Publishers;—Moscow, 1969, page 120. In Russian)

3. Ленин И. М. Автомобильные И тракторные двигатели (Теория, системы питания, конструкции И расчёт). Высш.школа, -М., 1969; стр. 90, 95. (Lenin, I. M. Automobile and tractor engines (Theory, feed circuits, designs and computation) Vyshaya shkola Publishers;—Moscow, 1969, pages 90, 95. In Russian)

4. Durst, F., Weclas, M. 2001, A new type of internal combustion engine based on the porous-medium combustion technique, J. Automobile Engineering, IMechE, part D, No. D04999, 215, pp. 63-81).

5. Stirling Engines. Grehem T. Reader, Charles Hooper. London N.Y.; E&F. N. Spon).

6. G. Walker. Stirling Engines; Clarendon Press, Oxford, 1980).

The invention claimed is:

1. A positive displacement rotary-piston machine comprising:

(a) a casing having an annular working chamber and intake and exhaust ports, (b) first and second drive shafts coaxial with the annular surface defining the working chamber and provided with rotary pistons on one end thereof and with arms on the other end thereof, (c) a stationary central gear coaxial with the surface defining the working chamber and with the drive shafts, (d) an output shaft concentric with the drive shafts and having an offset portion carrying a carrier and a planetary gear, (e) the planetary gear being in mesh with the stationary central gear on the internal teeth thereof with a gear ratio $i=n/(n+1)$, where n is a positive integer (i.e. n=1, 2, 3, 4, 5 . . . ), (f) the carrier being pivotally connected to the arms of both drive shafts through the connecting rods, and (g) the number of the rotary pistons mounted on each drive shaft being n+1, characterized in that (h) the annular working chamber of the casing has intake ports and exhaust ports and exit channels and entrance channels to pass overflow content(s) carried out beyond the annular working chamber, (i) the intake ports, the exit channels, the entrance channels, and the exhaust ports being sequentially and contiguously connected to the annular working chamber of the casing in the same direction as the rotary pistons move, (j) the intake ports and the exhaust ports as well as the exit channels and the entrance channels being arranged on each side of the site where the sides of the rotary pistons close the respective intake and exhaust ports and the respective exit and entrance channels, (k) and the sides of the rotary pistons in themselves having an angular width sufficient to simultaneously shutdown the exit channel and entrance channel.

2. The rotary-piston machine according to claim 1, characterized in that the exit channels and the entrance channels are formed as overflow chambers.

3. The rotary-piston machine according to claim 2, characterized in that the overflow chambers are mounted on hermetic heat-insulation gaskets, wherein the walls of the overflow chambers are lined with a highly porous gas-permeable and heat-resistant ceramic material.

4. The rotary-piston machine according to claim 1, characterized in that the annular working chamber of the casing is toroidal.

5. The rotary-piston machine of claim 1, characterized in that the casing has two stages where each stage has an annular working chamber wherein the first and second drive shafts and the rotary pistons are accommodated, wherein the output shaft has first and second offset portions carrying the respective carrier and the respective planetary gear in each of the multiple stages, the planetary gear being in mesh with the respective stationary central gear and the respective carrier being pivotally connected to the arms of the drive shafts through the connecting rods, and both of the stages of the annular working chamber and the first and second offset portions are set at an angle up to 180° relative to one another.

6. The rotary-piston machine of claim 1, characterized in that it comprises a geared power take-off shaft coaxial with the output shaft and carrying a gear wheel in mesh with an intermediate gear wheel positioned on the planetary gear.

7. The rotary-piston machine of claim 1, characterized in that the exit channels are connected through branch pipes to the inlet of a heater and the entrance channels are connected to the outlet of the heater, the intake ports being connected to the outlet of a cooler and the exhaust ports being connected to the inlet of the cooler.

8. The rotary-piston machine of claim 1, characterized in that there is a thermostatic throttle included between the outlet of a radiator and the entrance channels.

9. The rotary-piston machine of claim 1, characterized in that the exit channels are connected to an input manifold and the entrance channels are connected to an output manifold.

10. The rotary-piston machine of claim 1, characterized in that the rotary pistons have elastic gas-tight and moisture-proof inserts and/or hermetic voids with a resilient wall.

* * * * *